US009946174B2

(12) United States Patent
Shingu et al.

(10) Patent No.: US 9,946,174 B2
(45) Date of Patent: Apr. 17, 2018

(54) CONDUCTIVE SUPPORT FOR ELECTROPHOTOGRAPHIC PHOTORECEPTOR, ELECTROPHOTOGRAPHIC PHOTORECEPTOR, AND PROCESS CARTRIDGE

(71) Applicant: FUJI XEROX CO., LTD., Tokyo (JP)

(72) Inventors: Kenta Shingu, Kanagawa (JP); Masaru Agatsuma, Kanagawa (JP); Hiroshi Tamemasa, Kanagawa (JP); Daisuke Haruyama, Kanagawa (JP); Hiroaki Ogawa, Kanagawa (JP); Akihiko Nakamura, Kanagawa (JP); Shiori Okuda, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/236,561

(22) Filed: Aug. 15, 2016

(65) Prior Publication Data

US 2017/0269485 A1 Sep. 21, 2017

(30) Foreign Application Priority Data

Mar. 18, 2016 (JP) ..... 2016-056162

(51) Int. Cl.

| | |
|---|---|
| ***G03G 5/00*** | (2006.01) |
| ***G03G 5/04*** | (2006.01) |
| ***G03G 15/00*** | (2006.01) |

(52) U.S. Cl.

CPC ..... *G03G 5/04* (2013.01); *G03G 15/75* (2013.01)

(58) Field of Classification Search

CPC ..... G03G 5/04; G03G 15/75

See application file for complete search history.

(56) References Cited

U.S. PATENT DOCUMENTS

| | | | | |
|---|---|---|---|---|
| 2011/0129770 | A1* | 6/2011 | Aoki | G03G 5/0433 430/66 |
| 2012/0008984 | A1* | 1/2012 | Kami | G03G 5/0525 399/159 |
| 2012/0321348 | A1* | 12/2012 | Toriu | G03G 15/751 399/159 |
| 2014/0045109 | A1* | 2/2014 | Yamashita | G03G 5/04 430/56 |
| 2015/0003874 | A1* | 1/2015 | Aoyama | G03G 15/0233 399/176 |
| 2016/0291489 | A1* | 10/2016 | Sekido | G03G 5/142 |

FOREIGN PATENT DOCUMENTS

JP 2008-132503 A 6/2008

OTHER PUBLICATIONS

Aalco (Aluminium—Specification, Properties, Classifications and Classes, Supplier data by Aalco).*

* cited by examiner

*Primary Examiner* — Clayton E Laballe
*Assistant Examiner* — Ruifeng Pu
(74) *Attorney, Agent, or Firm* — Sughrue Mion, PLLC

(57) ABSTRACT

A conductive support for an electrophotographic photoreceptor includes a cylindrical member containing aluminum, wherein the cylindrical member has an arithmetic mean roughness Ra of 1.3 μm or less, a maximum height of roughness profile Rz of 5.0 μm or less, and a mean width of roughness profile elements RSm in an axial direction of 80 μm to 400 μm.

15 Claims, 15 Drawing Sheets

70
72
106
104
102
(102)
100

CONDUCTIVE SUPPORT FOR ELECTROPHOTOGRAPHIC PHOTORECEPTOR, ELECTROPHOTOGRAPHIC PHOTORECEPTOR, AND PROCESS CARTRIDGE

CROSS-REFERENCE TO RELATED APPLICATIONS

This application is based on and claims priority under 35 USC 119 from Japanese Patent Application No. 2016-056162 filed Mar. 18, 2016.

BACKGROUND

1. Technical Field

The present invention relates to a conductive support for an electrophotographic photoreceptor, an electrophotographic photoreceptor, and a process cartridge.

2. Related Art

In the related art, as an electrophotographic image forming apparatus, an apparatus sequentially performing steps of charging, exposing, developing, transferring, cleaning, and the like by using an electrophotographic photoreceptor (hereinafter, referred to as a "photoreceptor" in some case) has been widely known.

Examples of the electrophotographic photoreceptor include a function-separated type photoreceptor which is obtained by stacking a charge generation layer for generating charges by exposure and a charge transport layer for transporting the charges on a support such as aluminum having conductivity, and a single-layer type photoreceptor that has functions of generating and transporting the charges in the same layer.

As a method of preparing a cylindrical material which corresponds to the conductive support of the electrophotographic photoreceptor, a method of adjusting a thickness, surface roughness, and the like by cutting an outer circumferential surface of a tube material of aluminum or the like has been known.

Meanwhile, as a method of mass-producing a thin metal container or the like with low cost, an impact pressing method (referred to as an impact method) of molding a cylindrical metal member by imparting a shock (impact) to a metallic ingot (slag) which is disposed in a female mold (a concave mold) by a male mold (a punch mold) has been known.

SUMMARY

According to an aspect of the invention, there is provided a conductive support for an electrophotographic photoreceptor, including:

a cylindrical member containing aluminum, wherein the cylindrical member has an arithmetic mean roughness Ra of 1.3 μm or less, a maximum height of roughness profile Rz of 5.0 μm or less, and a mean width of roughness profile elements RSm in an axial direction of 80 μm to 400 μm.

BRIEF DESCRIPTION OF THE DRAWINGS

Exemplary embodiments of the present invention will be described in detail based on the following figures, wherein.

DETAILED DESCRIPTION

Figures 1A, 1B, 1C:
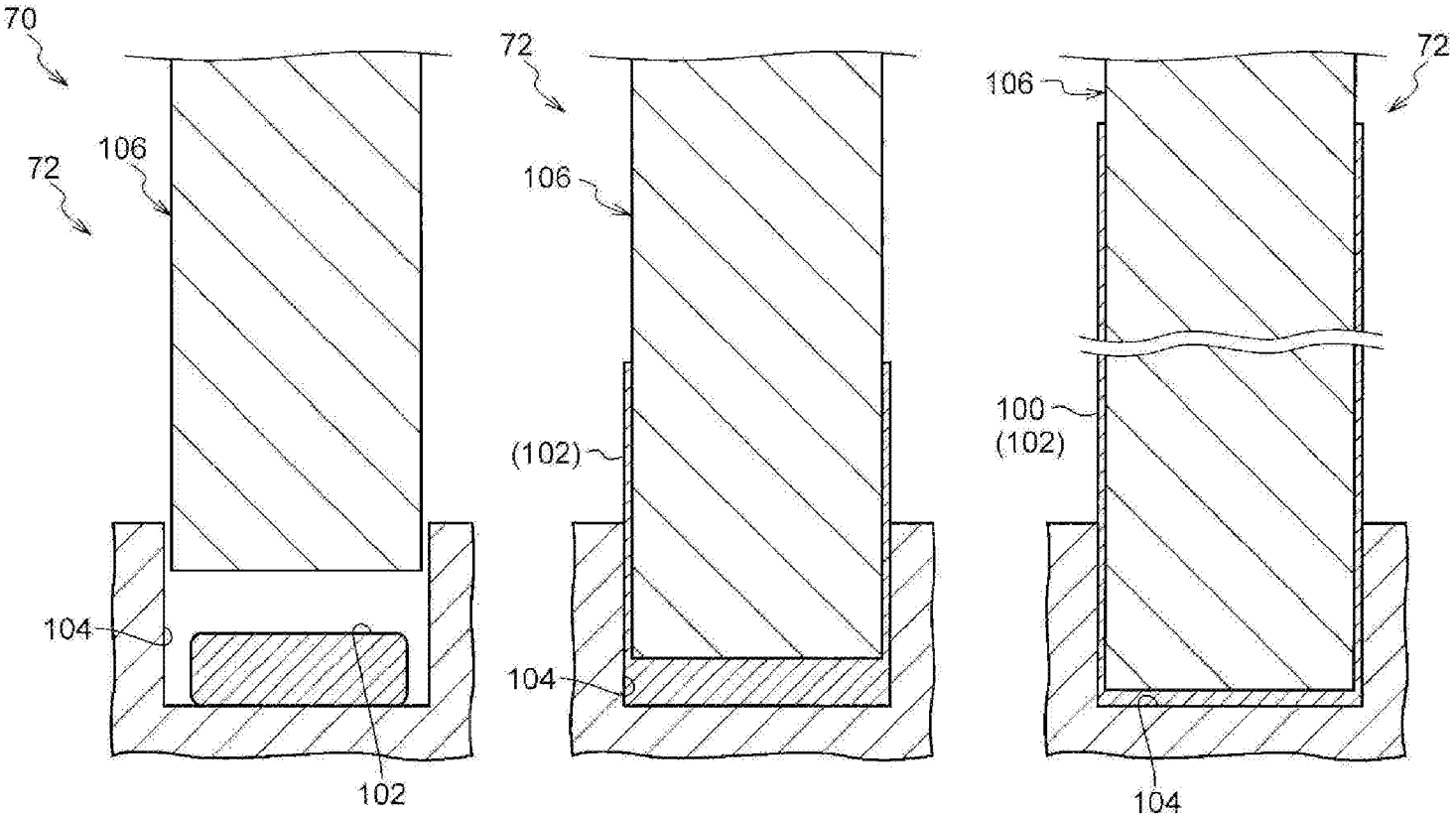
FIGS. 1A to 1C are schematic diagrams illustrating impacting apparatuses in this exemplary embodiment.

Herein below, exemplary embodiments will be described as an example of the present invention.

Conductive Support for Electrophotographic Photoreceptor

The conductive support for an electrophotographic photoreceptor (hereinafter, referred to as "conductive support" in some cases) according to the exemplary embodiment is formed of a cylindrical member containing aluminum.

In addition, the cylindrical member has an arithmetic mean roughness Ra of 1.3 μm or less, a maximum height of roughness profile Rz (hereinafter, also referred to as "maximum height Rz") of 5.0 μm or less, and a mean width of roughness profile elements RSm in the axial direction (hereinafter, referred to as "mean width RSm in the axial direction" or "mean width RSm" in some cases) of from 80 μm to 400 μm.

Here, the conductive support which is used as a core of the photoreceptor requires a technical strength (for example, surface hardness). In addition, the thickness is required to be thinned so as to realize the low price and low weight.

However, in accordance with the thinning of the conductive support, it is not easy to obtain a target surface shape. Typically, the photoreceptor is obtained by forming a film such as a photosensitive layer on the conductive support, and thus the surface shape of the conductive support is likely to reflect the surface of the photoreceptor, and when an image is formed by using the photoreceptor, the obtained image is also affected.

For example, the conductive support prepared by impacting has the high technical strength and the thin thickness;

however, a coarse concave portion (for example, the width of equal to or greater than 400 μm and the depth of equal to or greater than 5 μm) is likely to be formed on the surface. For this reason, when an image is formed by using the photoreceptor including the conductive support, it is easy to prevent the white point from occurring on the obtained image (a portion corresponding to the coarse concave portion).

In contrast, the conductive support of the exemplary embodiment is formed of the cylindrical member containing aluminum in which the arithmetic mean roughness Ra, the maximum height Rz, and the mean width RSm in the axial direction are adjusted to be in the above-described ranges. With this, in a case where an image is formed by using the photoreceptor including the conductive support, it is possible to obtain an image in which the occurrence of the color point and the white point is prevented.

Here, the fact that the arithmetic mean roughness Ra and the maximum height Rz are in the above-described ranges means that appropriate ruggedness exists on the surface of the conductive support, and the number of the coarse concave portions and the coarse convex portions (for example, width of equal to or greater than 400 μm and depth of equal to or greater than 5 μm) which are formed on the surface is reduced. In other words, it is considered that when the arithmetic mean roughness Ra and the maximum height Rz each are in the above-described ranges, the coarse concave portion and the coarse convex portion are less likely to be formed on the surface while the ruggedness is appropriately formed on the surface of the photosensitive layer formed on the conductive support.

With this, the occurrence of the white point caused by the coarse concave portion and the color point caused by the coarse convex portion is prevented. Note that, when the coarse convex portion exists on the surface of the conductive support, it is considered that due to the convex portion, a current locally flows into the photoreceptor, and thus a color point easily occurs on an image.

In addition, in the exemplary embodiment, the arithmetic mean roughness Ra and the maximum height Rz are in the above-described ranges, and furthermore, the mean width RSm in the axial direction is set to be in the above-described range.

Here, the fact that the mean width RSm in the axial direction is in the above-described range means that in the axial direction of the conductive support, a period of the surface ruggedness is almost constant.

That is, it is considered that in addition to the arithmetic mean roughness Ra and the maximum height Rz, the mean width RSm in the axial direction is also in the above-described range, the ruggedness is regularly formed on the surface of the conductive support, and thus it is less likely that the coarse concave portion and the coarse convex portion are formed on the surface of the photosensitive layer formed on the conductive support.

As described above, when an image is formed by using the photoreceptor including the conductive support of the exemplary embodiment, it is possible to obtain an image in which the occurrence of color point and white point is prevented.

In addition, in the conductive support, the conductive support having the mean width RSm in the axial direction which is greater than the above-described range, that is, as the conductive support having the mean width RSm which is greater than 400 μm, for example, an impact press tube (hereinafter, referred to as impact press tube C) prepared by using a slag which is scratched in advance through impacting. Specifically, the impact press tube C is prepared by pressurizing the slag which is scratched in advance in a columnar male mold (punch mold), and plastically deforming the slag on the outer circumferential surface of the punch mold. In the impact press tube C obtained by the method, as compared with the concave portion of the surface of the conductive support of the exemplary embodiment, in the concave portion of the surface, the width in the circumferential direction is longer than the width in the axial direction (the concave portion extended in the axial direction). For this reason, the conductive support of the exemplary embodiment and the impact press tube C have different configurations.

Hereinafter, the conductive support of the exemplary embodiment will be described in detail.

The conductive support is formed of a cylindrical member containing aluminum. The "conductivity" means a case where the volume resistivity is less than $10^{13}$ Ωcm.

Arithmetic Mean Roughness Ra

The arithmetic mean roughness Ra of the conductive support (cylindrical member) of the exemplary embodiment is an average of the absolute values of the roughness profile in the reference length which is regulated by JISB0601 (2013), and is a value measured by using a surface roughness measuring machine (SURFCOM, manufactured by Tokyo Seimitsu Co., Ltd.). A measuring method will be described in detail.

The arithmetic mean roughness Ra of the conductive support of the exemplary embodiment is preferably 1.3 μm or less, more preferably 1.0 μm or less, and further preferably 0.6 μm or less in order to obtain the image in which the occurrence of color point and white point is prevented. Meanwhile, the lower limit is preferably 0.3 μm, in order to prevent the interference fringe of the photoreceptor. When the arithmetic mean roughness Ra is equal to or less than 1.3 μm, the coarse concave portion and the coarse convex portion on the surface are easily reduced. With this, when an image is formed by using the photoreceptor including the conductive support, it is easy to prevent the white point caused by the coarse concave portion and the color point caused by the coarse convex portion from being formed on the surface.

Note that, in a case where the photoreceptor including the conductive support (cylindrical member) is used for a laser printer, an oscillation wavelength of the laser is preferably from 350 nm to 850 nm, and as the wavelength is shorter, a resolution becomes excellent, and thus the short wavelength is preferably used. In this case, in order to prevent the interference fringe from occurring on the surface of the cylindrical member at the time of applying a laser beam, it is preferable that the surface of the cylindrical member is roughened so as to provide an arithmetic mean roughness Ra of from 0.3 μm to 1.3 μm. When the arithmetic mean roughness Ra is 0.3 μm or more, it is easy to obtain an interference prevention effect. On the other hand, when the arithmetic mean roughness Ra is 1.3 μm or less, at the time of forming an image by using the photoreceptor including the cylindrical member, it is possible to efficiently prevent the obtained image from being roughened.

Maximum Height of Roughness Profile Rz

The maximum height of roughness profile Rz of the conductive support (cylindrical member) of the exemplary embodiment is a total sum of the maximum height of a peak and the maximum depth of a trough of the roughness profile in the reference length which is regulated by JISB0601 (2013), and a value measured by using a surface roughness measuring machine (SURFCOM, manufactured by Tokyo Seimitsu Co., Ltd.). The measuring method will be described in detail.

The maximum height Rz of the conductive support of the exemplary embodiment is equal to or less than 5.0 μm, is preferably equal to or less than 4.0 μm, and is further preferably equal to or less than 3.0 μm in order to obtain the image in which the occurrence of color point and white point is prevented. Meanwhile, the lower limit is preferably 1.0 μm in order to prevent the interference fringe of the photoreceptor.

When the maximum height Rz is set to be equal to or less than 5.0 μm, the coarse concave portion and the coarse convex portion are less likely to be formed on the surface. With this, when an image is formed by using the photoreceptor including the conductive support, it is easy to prevent the white point caused by the coarse concave portion and the color point caused by the coarse convex portion from being formed on the surface.

Mean Width RSm of Roughness Profile Elements in Axial Direction

The mean width RSm of roughness profile elements in the axial direction of the conductive support (cylindrical member) of the exemplary embodiment is a mean width of roughness profile elements in the reference length which is regulated by JISB0601 (2013), and is a value measured by using a surface roughness measuring machine (SURFCOM, manufactured by Tokyo Seimitsu Co., Ltd.). The measuring method will be described in detail.

The mean width RSm of the conductive support of the exemplary embodiment in the axial direction is from 100 μm to 350 μm, is preferably from 150 μm to 300 μm, and is further preferably from 200 μm to 250 μm in order to obtain the image in which the occurrence of color point and white point is prevented.

When the mean width RSm in the axial direction is set to be equal to or greater than 80 μm, it is likely that the ruggedness is regularly formed on the surface of the conductive support. With this, it is further less likely that the coarse concave portion and the coarse convex portion are formed on the surface of the photosensitive layer formed on the conductive support.

On the other hand, when the mean width RSm in the axial direction is set to be equal to or less than 400 μm, it is easy to prevent the coarse concave portion from being formed. With this, when an image is formed by using the photoreceptor including the conductive support, it is less likely that a white point is generated on the obtained image.

Measurement of Arithmetic Mean Roughness Ra, the Maximum Height Rz, and Mean Width RSm in Axial Direction The arithmetic mean roughness Ra, the maximum height Rz, and the mean width RSm in the axial direction are measured as follows.

In the axial direction of the conductive support (cylindrical member), an area of 120 mm in total, such as an area of 40 mm from a point of 10 mm to a point of 50 mm from one side, an area of 40 mm from a point of 10 mm to a point of 50 mm from the other side, and an area of 40 mm in the center portion of the support member is scanned in the axial direction so as to measure the surface shape (roughness profile). Note that, the scanning in the axial direction is performed every 10 degrees a total of 36 times in the circumferential direction.

The arithmetic mean roughness Ra, the maximum height Rz, and the mean width RSm in the axial direction are calculated based on the roughness profile obtained through the above-described scanning.

Specifically, the arithmetic mean roughness Ra is calculated by obtaining "the mean of absolute values of the roughness profiles" from the roughness profile obtained through the above-described 36 times of the scannings.

The maximum height Rz is calculated by obtaining "the total sum of the maximum height of a peak and the maximum depth of a trough" from the roughness profile obtained through the above-described 36 times of the scannings.

The mean width RSm in the axial direction is calculated by obtaining "the mean width of the roughness profile elements" from the roughness profile obtained through the above-described 36 times of the scannings.

The method of adjusting the arithmetic mean roughness Ra, the maximum height Rz and the mean width RSm in the axial direction of the conductive support to be in the above-described ranges is not limited, and examples thereof include a method of roughening (imparting the ruggedness to the surface) the surface of the cylindrical metal member (outer circumferential surface) which is cylindrically molded, such as an etching method, an anodizing method, a rough cutting method, a centerless grinding method, a blasting treatment (for example, sandblast), and a wet honing. Among them, the surface of the cylindrical member is preferably roughened by using the blasting treatment. Note that, two or more roughening methods may be employed.

Surface Hardness

The surface of the conductive support hardness is preferably from 45 HV to 60 HV, is preferably from 48 HV to 58 HV, and further still preferably from 50 HV to 55 HV in order to enhance the technical strength.

The surface hardness (Vickers hardness) is measured by pushing an indenter from the surface of the cylindrical member with a Vickers hardness tester (product name: MVK-HVL, manufactured by Mitutoyo Corporation) based on the measurement conditions of indentation load of 1 kgf and pushing time of 20 seconds. The measurement is performed at total 12 points for each sample, for example, four points in the circumferential direction and three points in the axial direction. In the exemplary embodiment, the surface hardness of the conductive support is the average value of the hardness measured at the 12 points.

The arithmetic mean roughness Ra, the maximum height Rz, and the mean width RSm in the axial direction are in the above-described ranges. It is preferable that the conductive support in which the surface hardness is in the above-described range is an impact press tube prepared by impacting.

The impact press tube generally has high hardness (for example, equal to or greater than 45 HV) through the work hardening. Accordingly, when the impact press tube is employed as the conductive support of the exemplary embodiment, the high hardness is exhibited as compared with the cylindrical member which is subjected to the cutting on the surface of the same type of aluminum cylindrical tube (tube material). In addition, according to the impact press tube, it is possible to thin the thickness of the cylindrical member. A method of preparing an impact press tube will be described below.

The thickness of the conductive support of the exemplary embodiment is not particularly limited, and is preferably from 0.3 mm to 0.7 mm, and further preferably from 0.35 mm to 0.5 mm in order to obtain the image in which the occurrence of color point and white point is prevented.

Method of Preparing Conductive Support for an Electrophotographic Photoreceptor

First Embodiment

The method of preparing a conductive support according to the first embodiment is a method of preparing a conductive support which includes an impacting step of pressurizing a slag containing aluminum which is disposed in a female mold (hereinafter, referred to as a concave mold) by the columnar male mold (hereinafter, referred to as a punch mold) so as to mold a cylindrical member by plastically deforming the slag on outer an circumferential surface of the male mold, an ironing step of ironing the outer circumferential surface of the cylindrical member by causing the molded cylindrical member to pass the inner portion of an annular pressing mold having an inner diameter which is smaller than the outer diameter of the cylindrical member, and a blast step of imparting ruggedness on the outer circumferential surface of the ironed cylindrical member, in which a conductive support formed of the cylindrical member having an arithmetic mean roughness Ra of 1.3 μm or less, a maximum height Rz of 5.0 μm or less, and an mean width RSm of the roughness profile elements in the axial direction of from 80 μm to 400 μm is obtained.

According to the method of preparing the conductive support of the first embodiment, a conductive support may obtain an image in which the occurrence of color point and white point is prevented is prepared.

In addition, according to the above-described preparing method, it is possible to obtain the cylindrical member (impact press tube) having the high hardness as compared with the cylindrical member prepared by the cutting. Further, the coarse concave portion and the coarse convex portion are prevented from being formed, and thus regarding the quality of the hardness, it is possible to prepare a cylindrical member having the same quality of the conductive support (cylindrical member) which is prepared in the cutting step. With this, an automatic surface inspection may be omitted at the time of mass-producing the cylindrical member.

Hereinafter, an example of the method of preparing the conductive support of the first embodiment will be described with reference to FIG. 1 to FIG. 11.

In the following description, the finally prepared cylindrical member is referred to as a "molded cylindrical member" or a "conductive support" in some cases. In addition, members having substantially the same function are denoted the same signs all through the drawings, and repeated description and signs are omitted in some cases. Note that, an arrow "UP" in the drawings indicates a vertical direction.

First, a preparing apparatus 70 of the cylindrical member will be described, and then a method of preparing a conductive support (cylindrical member) which is performed by using the preparing apparatus 70 of the cylindrical member will be described.

Major Components: Preparing Apparatus of Cylindrical Member

The preparing apparatus 70 of the cylindrical member includes an impacting apparatus 72 that molds the cylindrical member 100, an ironing apparatus 74 that corrects the shape of cylindrical member 100, and a blasting apparatus 76 that causes the ruggedness on the outer circumferential surface of the cylindrical member 100.

Hereinafter, the impacting apparatus 72, the ironing apparatus 74, and the blasting apparatus 76 are described in order.

Impacting Apparatus

As illustrated in FIG. 1A, the impacting apparatus 72 is provided with a concave mold 104 in which a slag 102 which is an aluminum ingot is stored, and a columnar punch mold 106 which compresses the slag 102 stored in the concave mold 104 such that the slag 102 is made to be a cylindrical member (cylindrical member).

Meanwhile, operations of the respective portions of the impacting apparatus 72 are described in actions in the following description, and when the impacting apparatus 72 is used, one end portion 100A is opened and a cylindrical member 100 (refer to FIG. 4B) having a bottom plate 100B is formed at another end portion.

Ironing Apparatus

Next, the ironing apparatus 74 will be described. Note that, regarding the ironing apparatus 74, a mold structure provided in the ironing apparatus 74 will be mainly described.

Figure 2:
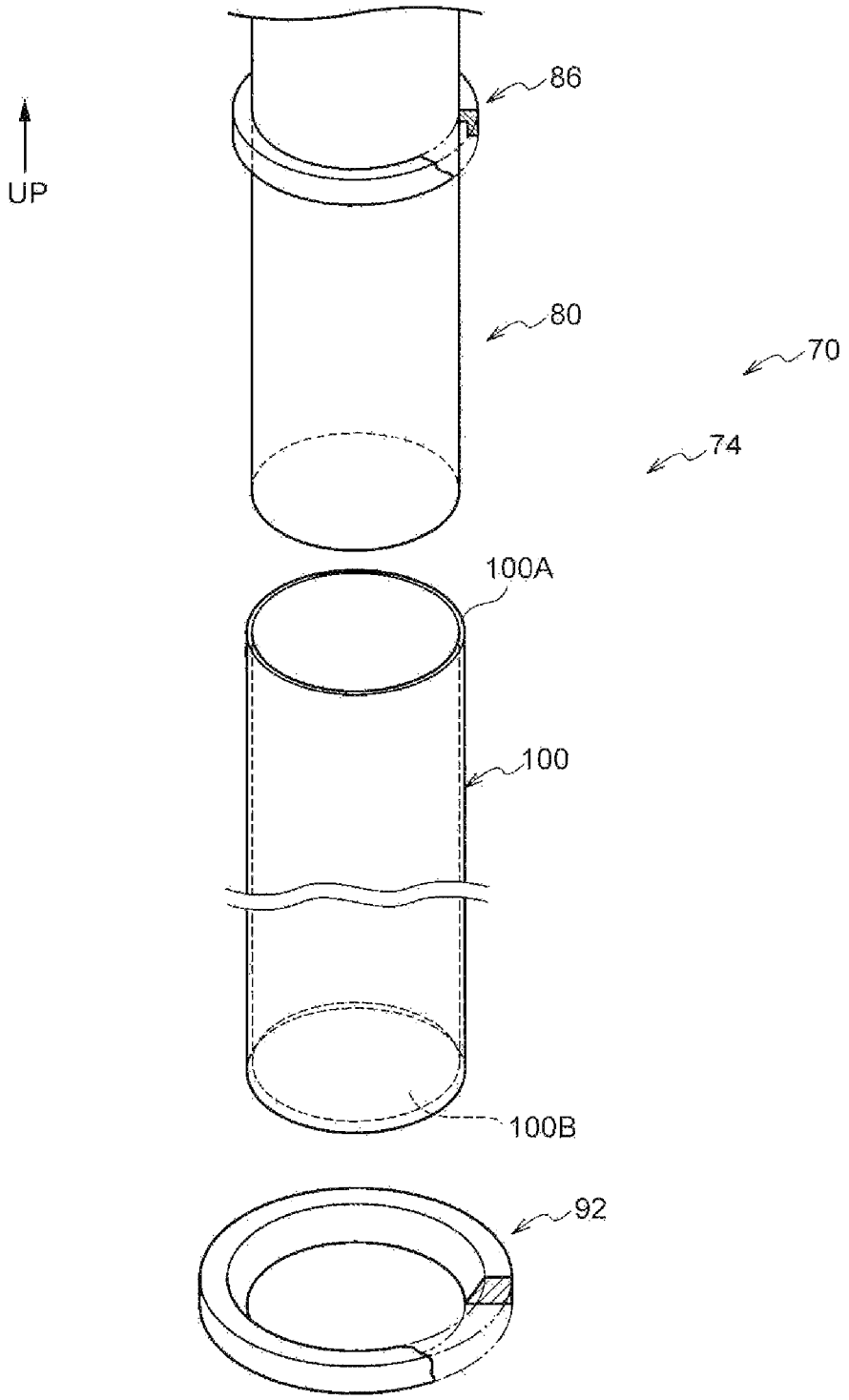
FIG. 2 is a schematic diagram illustrating an ironing apparatus in the exemplary embodiment.

As illustrated in FIG. 2, the ironing apparatus 74 is provided with a columnar mold 80 in which a portion on the tip end side is inserted into the molded cylindrical member 100 by impacting, and a preventing member 86 which prevents the movement of one end portion 100A of the cylindrical member 100. Further, the ironing apparatus 74 is provided with a pressing mold 92 in which the cylindrical member 100 is pressed to the outer circumferential surface of the columnar mold 80, and a mold releasing member 96 (refer to FIG. 9) which allows the cylindrical member 100 to be released from the columnar mold 80.

Columnar Mold

The columnar mold 80 is molded by using die steel (JIS-G4404: SKD11), and is a columnar extending in the vertical direction as illustrated in FIG. 2. In addition, the outer diameter (D1 in FIG. 5) of the columnar mold 80 is smaller than the inner diameter (D2 in FIG. 5) of the cylindrical member 100.

Figure 5:
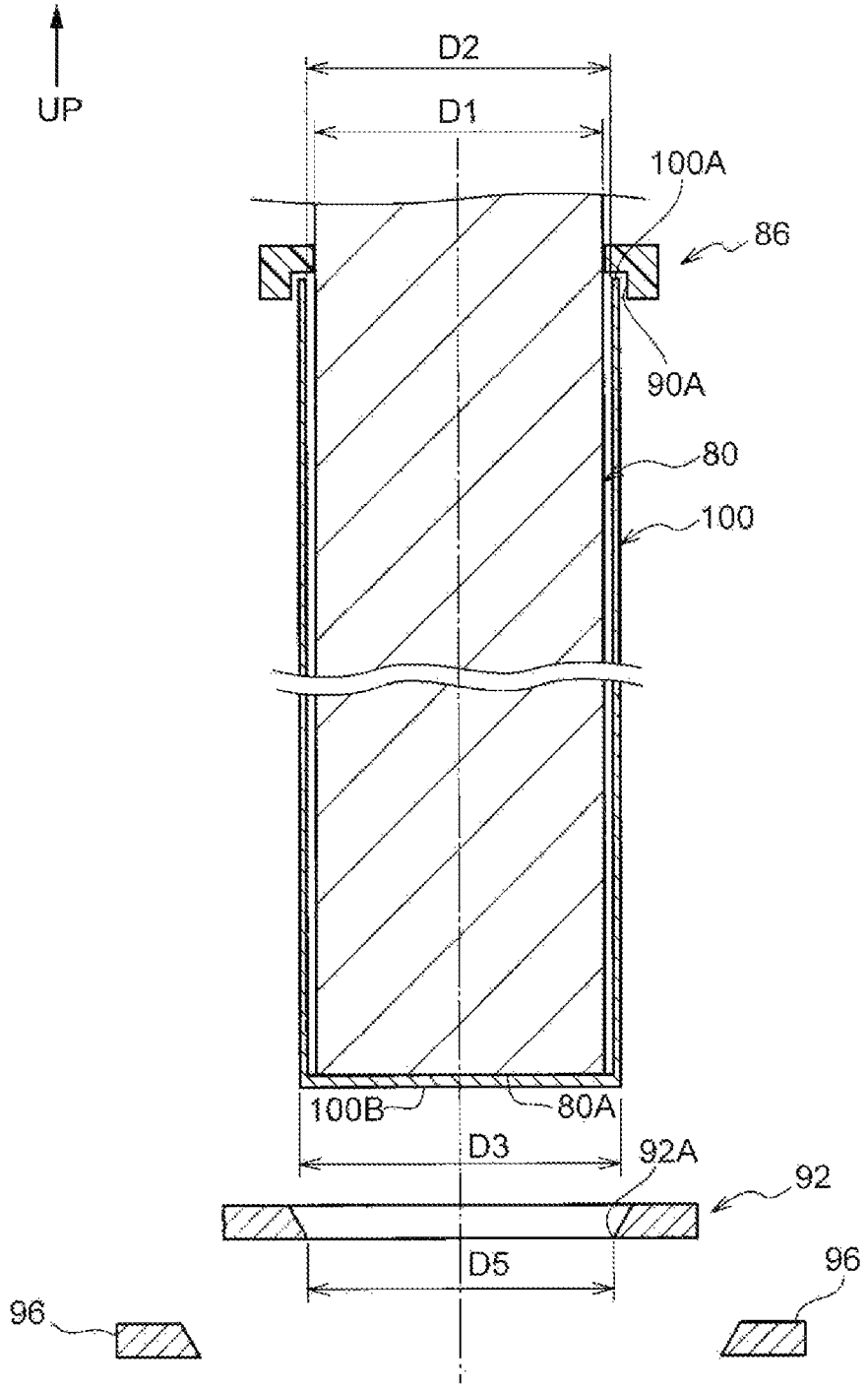
FIG. 5 is a sectional view of the mold structure in the exemplary embodiment.

For this reason, as illustrated in FIG. 5, in a state where a tip end portion 80A of the columnar mold 80 in which a portion on the tip end side (a portion on the lower side in FIG. 5) is inserted into the cylindrical member 100 contacts a bottom plate 100B of the cylindrical member 100 (hereinafter, referred to as "a state where the cylindrical member 100 is mounted to the columnar mold 80"), an interval is formed between the outer circumferential surface of the columnar mold 80 and the inner circumferential surface of the cylindrical member 100.

In this configuration, the columnar mold 80 to which a driving force is transferred from a driving source (not shown) is moved in the vertical direction.

Pressing Mold

The pressing mold 92 is molded by using, for example, cemented carbide (JISB4053-V10), and is formed into an annular as illustrated in FIG. 2. In addition, as illustrated in FIG. 5, the pressing mold 92 is configured such that the center line of the pressing mold 92 overlaps the center line of the columnar mold 80. In addition, an annular protrusion 92A which is projected to the inner side of the pressing mold 92 in the radial direction is formed in the pressing mold 92.

The inner diameter (D5 in FIG. 5) of the protrusion 92A is larger than the outer diameter (D1 in FIG. 5) of the columnar mold 80, and is smaller than the outer diameter (D3 in FIG. 5) of the cylindrical member 100 after being formed by impacting.

With such a configuration, the columnar mold 80 in the state where the cylindrical member 100 is mounted to the columnar mold 80 is moved to the lower side, and the cylindrical member 100 passes through the inside of the pressing mold 92 such that the pressing mold 92 presses the cylindrical member 100 to the outer circumferential surface of the columnar mold 80.

Preventing Member

Figure 11:
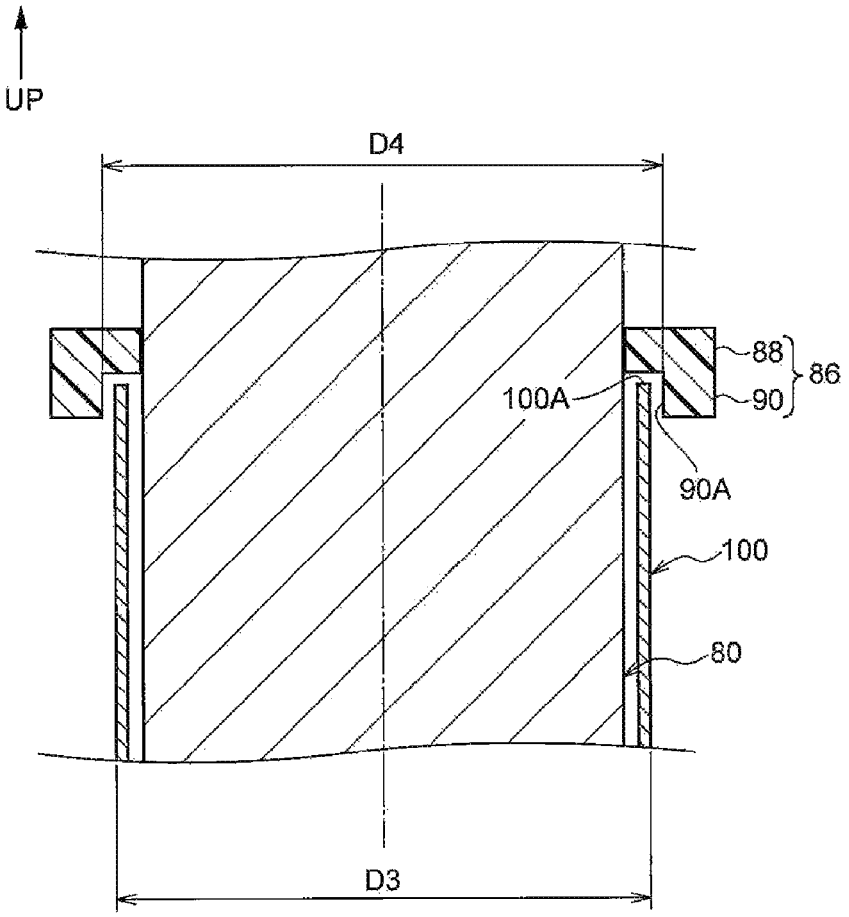
FIG. 11 is an enlarged sectional view of the mold structure in the exemplary embodiment.

The preventing member 86 is formed by using, for example, a nylon resin, and is formed into an annular shape as illustrated FIG. 2. In addition, the preventing member 86 includes a cylindrical portion 88 in which the inner circumferential surface contacts the outer circumferential surface of the columnar mold 80, and a projecting portion 90 downwardly projecting from the cylindrical portion 88, as illustrated in FIG. 11. Specifically, the projecting portion 90 downwardly projects from the portion of the outer side of the cylindrical portion 88 in the radial direction of the cylindrical portion 88. Further, a prevention surface 90A which faces the outer circumferential surface on the one end portion 100A side of the cylindrical member 100 is formed in the projecting portion 90 in the state where the cylindrical member 100 is mounted to the columnar mold 80. In addition, the prevention surface 90A is formed into a round shape when seen from the vertical direction (the axial direction of the columnar mold 80). An inner diameter (D4 in FIG. 11) of the prevention surface 90A of the preventing member 86 is larger than an outer diameter (D3 in FIG. 11) of the cylindrical member 100 after being molded by impacting.

With such a configuration, in the state where the cylindrical member 100 is mounted to the columnar mold 80, the preventing member 86 is configured to prevent the movement of the one end portion 100A of the cylindrical member 100 in the radial direction (the horizontal direction in FIG. 11) of the columnar mold 80. Further, when a force is applied to the preventing member 86 in the vertical direction (the axial direction of the columnar mold 80), the preventing member 86 slides the outer circumferential surface of the columnar mold 80.

Mold Releasing Member

Figure 9:
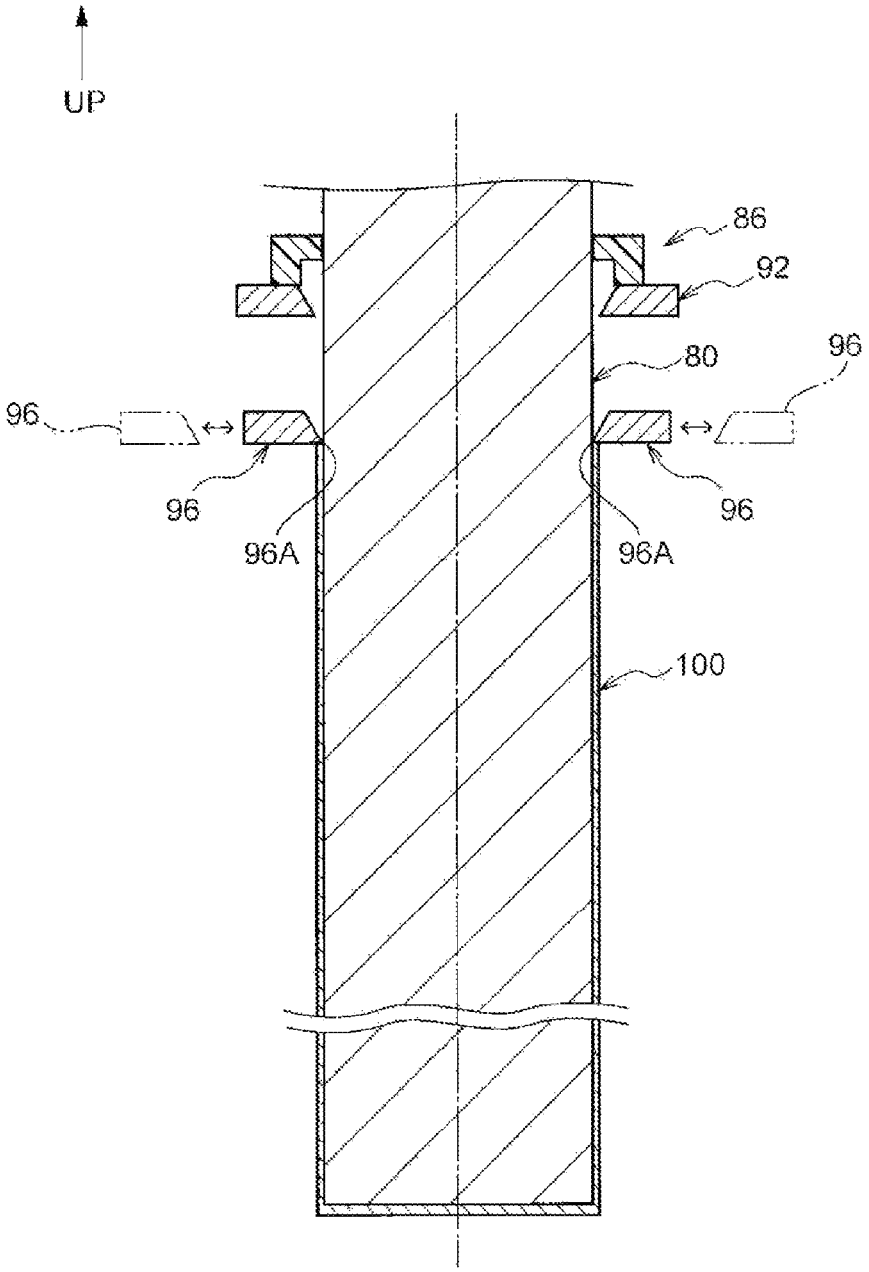
FIG. 9 is a sectional view of the mold structure in the exemplary embodiment.

As illustrated in FIG. 9, two of the mold releasing members 96 which are molded by using, for example, a metal material are provided on the lower side with respect to the pressing mold 92 so as to sandwich the columnar mold 80 of a portion which is moved to the lower side with respect to the pressing mold 92 from the radial direction of the columnar mold 80. In addition, a projection 96A which projects toward the outer circumferential surface of the columnar mold 80 is formed in each of the pressing molds 92.

With such a configuration, each of the mold releasing members 96 to which the driving force is transferred from the driving source (not shown) is moved to the direction (in the horizontal direction in FIG. 9) intersecting with the axial direction of the columnar mold 80. Also, each of the mold releasing members 96 is moved to between a contact position (a solid line in FIG. 11) where the projection 96A contacts the columnar mold 80 and a separated position (a two-dot chain in FIG. 11) where the projection 96A is separated from the columnar mold 80.

Meanwhile, operations of the respective portion of the ironing apparatus 74 will be described together with actions thereof.

Blasting Apparatus

Next, the blasting apparatus 76 will be described. The blasting apparatus 76 in the exemplary embodiment is a sandblasting apparatus.

Figure 3:
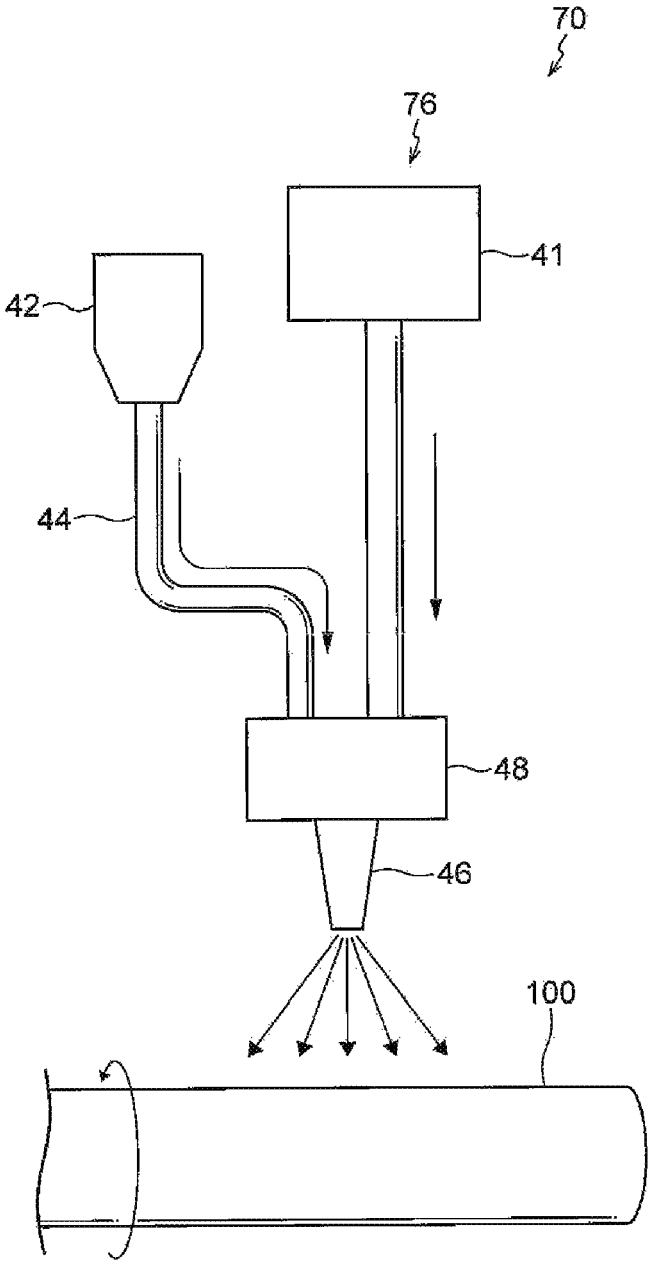
FIG. 3 is a schematic diagram illustrating a blasting apparatus in the exemplary embodiment.

As illustrated in FIG. 3, the blasting apparatus 76 is provided with a compressing machine (compressor) 41 for supplying compressed air, a container (tank) 42 for storing a polishing material (not shown), a mixing unit 48 for mixing the polishing material supplied via a supply tube 44 from the tank 42 and the compressed air supplied from the compressor 41, and a nozzle 46 for ejecting the polishing material from the mixing unit 48 under the compressed air such that the ejected polishing material is blown to the cylindrical member 100.

Action of Major Configurations

Next, the action of the major configurations will be described through the steps of preparing the cylindrical member 100 by using the preparing apparatus 70 of the cylindrical member. Specifically, an impacting step, an ironing step, and a blast step will be described.

Impacting Step

First, the impacting step of molding the cylindrical member 100 by using the impacting apparatus 72 will be described with reference to FIG. 1 and FIGS. 4A and 4B.

The impacting step is a step of pressurizing a slag containing aluminum which is disposed in the concave mold 104 by using the columnar punch mold 106, and then molding the cylindrical member 100 by plastically deforming the slag 102 on the outer circumferential surface of the punch mold 106.

In the impacting step, first, as illustrated in FIG. 1A, the slag 102 is stored in the concave mold 104, and the punch mold 106 is disposed on the upper side of the concave mold 104.

Next, as illustrated in FIGS. 1B and 1C, the punch mold 106 is moved to the lower side, and the punch mold 106 crushes and deforms the slag 102 stored in the concave mold 104. With this, the slag 102 is deformed to be cylindrical member 100 having a bottom along the circumferential surface of punch mold 106.

Figure 4B:
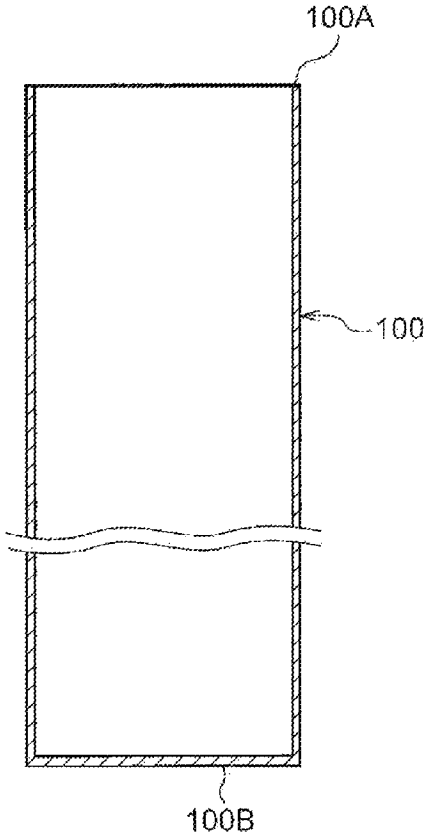
FIGS. 4A and 4B are sectional views of a mold structure in the exemplary embodiment.
Figure 4A:
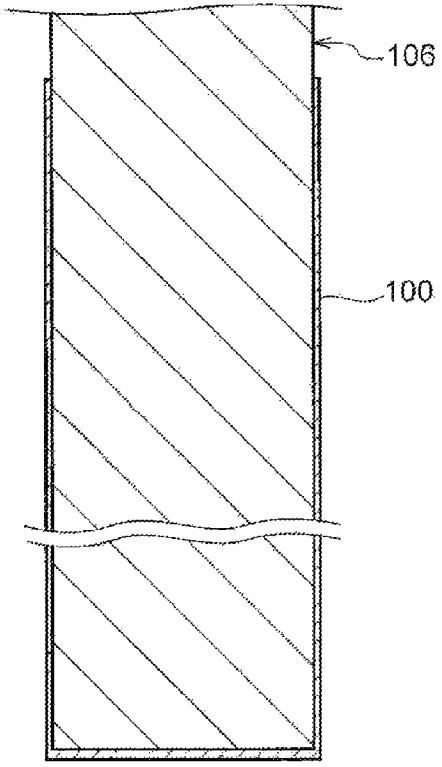

Next, the punch mold 106 is moved to the upper side such that the cylindrical member 100 which is closely attached to the punch mold 106 is separated from the concave mold 104 as illustrated in FIG. 4A.

Next, as illustrated in FIG. 4B, the cylindrical member 100 including the bottom plate 100B at another end portion to which one end portion 100A is opened is detachable (separated) from the punch mold 106.

In this way, the cylindrical member 100 is molded by using the impacting apparatus 72.

Ironing Step

Next, the ironing step of correcting the shape of cylindrical member 100 by using the ironing apparatus 74 will be described with reference to FIG. 2, FIG. 5 to FIG. 10.

The ironing step is a step of ironing the outer circumferential surface of the cylindrical member 100 by allowing the molded cylindrical member 100 to pass through the inside of the annular pressing mold 92 having an inner diameter which is smaller than the outer diameter of the cylindrical member 100.

In the ironing step, first, as illustrated in FIG. 5, the columnar mold 80 is disposed on the upper side with respect to the pressing mold 92 in a state where the tip end portion 80A of the columnar mold 80 to which the portion on the tip end side of the columnar mold 80 is inserted contacts the bottom plate 100B of the cylindrical member 100. In addition, in this state, the prevention surface 90A of the preventing member 86 faces the outer circumferential surface on the one end portion 100A side of the cylindrical member 100. Further, the mold releasing member 96 is disposed in the separated position.

Figure 6:
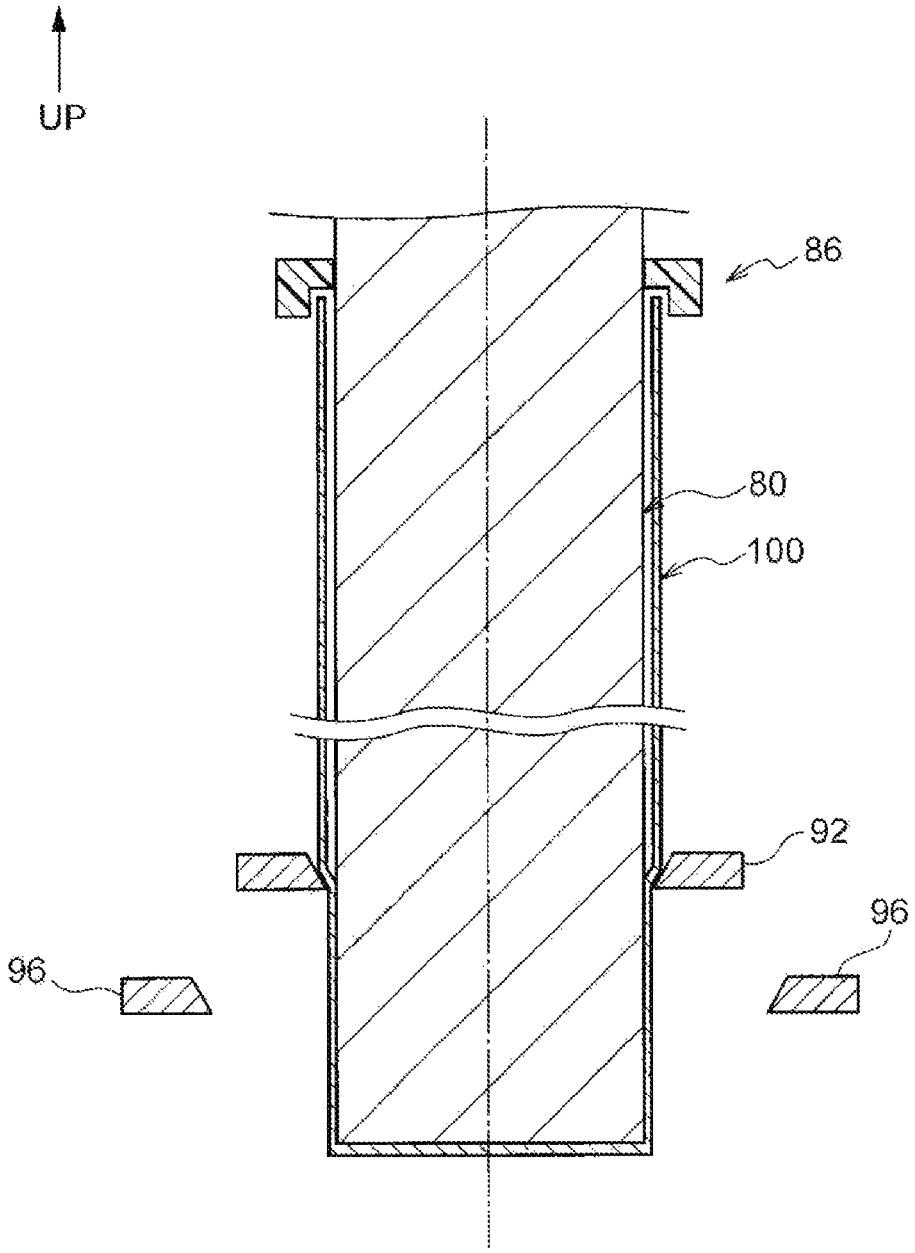
FIG. 6 is a sectional view of the mold structure in the exemplary embodiment.

Next, as illustrated in FIG. 6, the columnar mold 80 is moved to the lower side, and the cylindrical member 100 passes through the inside of the pressing mold 92 such that the pressing mold 92 presses the cylindrical member 100 to the outer circumferential surface of the columnar mold 80.

With this, the portion which passes through the inside of the pressing mold 92 in the cylindrical member 100 is plastically deformed so as to contact the outer circumferential surface of the columnar mold 80.

Figure 7:
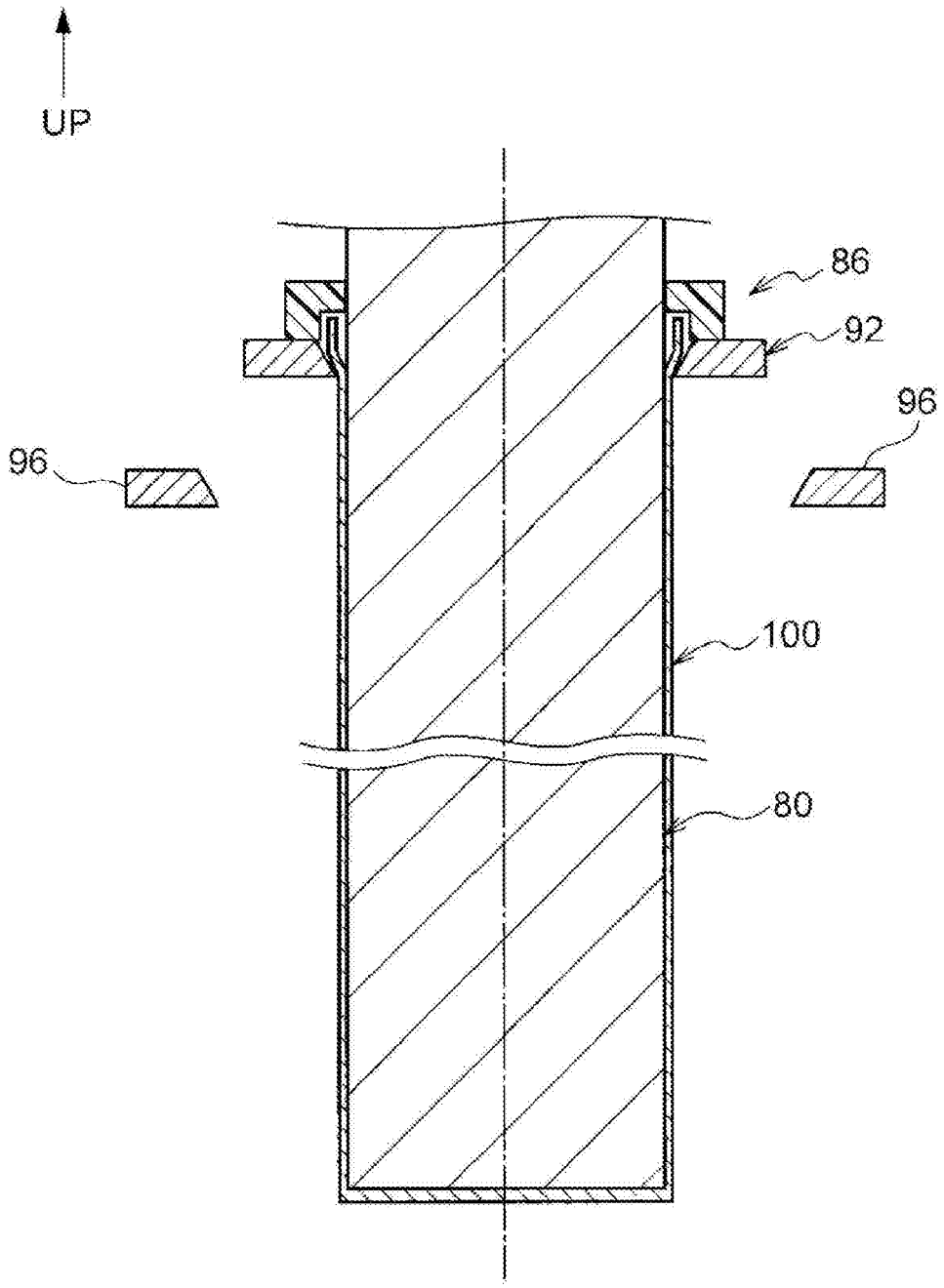
FIG. 7 is a sectional view of the mold structure in the exemplary embodiment.
Figure 8:
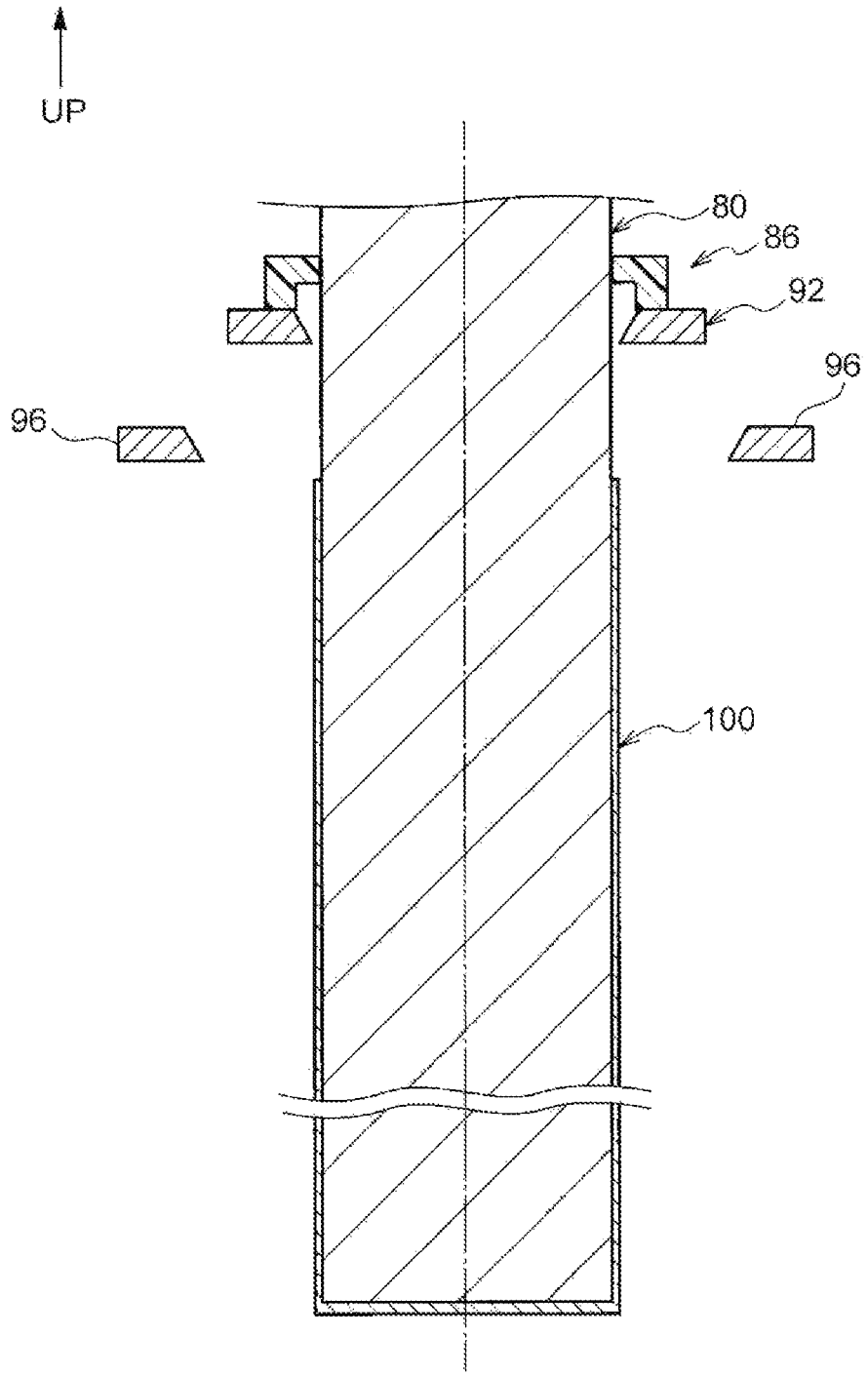
FIG. 8 is a sectional view of the mold structure in the exemplary embodiment.

Next, as illustrated in FIG. 7, the columnar mold 80 is further moved to the lower side such that the preventing member 86 contacts the pressing mold 92. Then, the columnar mold 80 is further moved to the lower side such that the preventing member 86 slides the outer circumferential surface of the columnar mold 80 as illustrated in FIG. 8. The cylindrical member 100 is moved to the lower side of the mold releasing member 96 in the vertical direction. When the cylindrical member 100 is moved to the lower side of the mold releasing member 96 in the vertical direction, the movement of the columnar mold 80 to the lower side is stopped.

Next, as illustrated in FIG. 9, the mold releasing member 96 moves to a contact position from the separated position.

Figure 10:
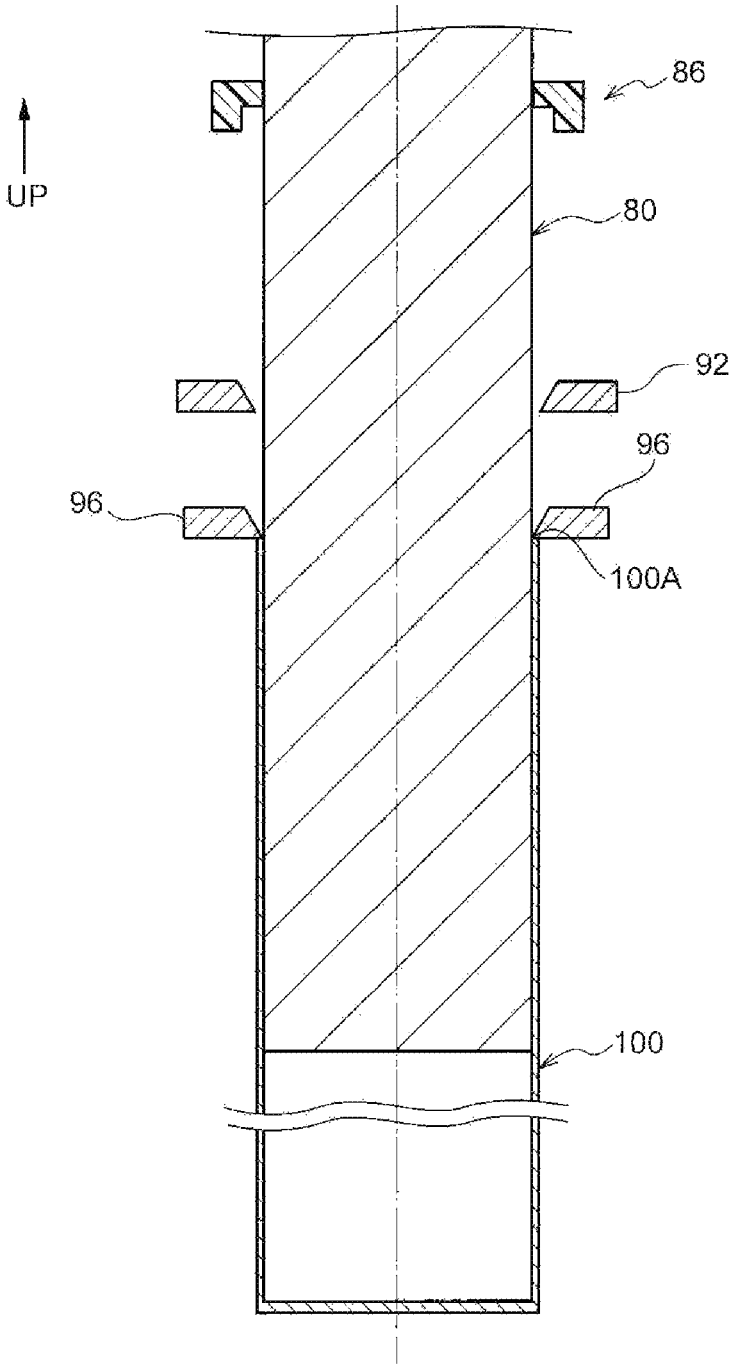
FIG. 10 is a sectional view of the mold structure in the exemplary embodiment.

Next, as illustrated in FIG. 10, the columnar mold 80 is moved to the upper side such that the mold releasing member 96 contacts the one end portion 100A of the cylindrical member 100, and the mold releasing member 96 regulates the movement of the cylindrical member 100 to the upper side. With this, the cylindrical member 100 is separated from the columnar mold 80, and thereby the ironing step is completed.

Blast Step

Subsequently, the blast step of roughening the surface (outer circumferential surface) of the cylindrical member 100 by using the blasting apparatus 76 will be described with reference to FIG. 3.

The blast step is a step of imparting (roughening the surface) the ruggedness to the outer circumferential surface of the ironed cylindrical member 100.

In the blast step, first, as illustrated in FIG. 3, the polishing material (not shown) stored in the tank 42 is supplied to the mixing unit 48 via the supply tube 44, and the polishing material and the compressed air supplied from the compressor 41 are mixed with each other in the mixing unit 48. Then, the polishing material is ejected from the mixing unit 48 via nozzle 46 under the compressed air such that the ejected polishing material is blown to the cylindrical member 100. With this, the surface of the cylindrical member 100 is roughened. Note that, at the time of roughening the surface of the cylindrical member 100, the cylindrical member 100 is rotated with the driving force transferred from the driving source (not shown).

The polishing material is not particularly limited, and well-known polishing materials may be used. Examples of the well-known polishing materials include metal (for example, stainless steel, iron, and zinc), ceramic (for example, zirconia, alumina, silica, and silicon carbide), and a resin (for example, polyamide and polycarbonate).

In order to adjust the arithmetic mean roughness Ra, the maximum height Rz, and the mean width RSm in the axial direction of the cylindrical member 100 to be in the specific ranges, the size of the polishing material, the irradiation pressure, and the irradiation time may be set to be in the following ranges. Note that, the irradiation pressure of the polishing material means the pressure when the polishing material is blown to the cylindrical member 100.

The size of the polishing material is, for example, preferably from 30 μm to 300 μm, and is further preferably from 60 μm to 250 μm.

The irradiation pressure of the polishing material is, for example, preferably from 0.1 MPa to 0.5 MPa, and is further preferably from 0.15 MPa to 0.4 MPa.

The irradiation time of the polishing material is, for example, preferably from 5 seconds to 30 seconds, and is further preferably from 10 seconds to 20 seconds.

Meanwhile, a supply source of the compressed air is not particularly limited, and may be a centrifugal blowing device (blower) instead of the compressor 41, and the compressed air is not necessarily used. In addition, an ejection medium may be a gas other than air.

Further, after the blast step, the bottom plate 100B (refer to FIGS. 4A and 4B) of the cylindrical member 100 is cut off so as to prepare the conductive support (molded cylindrical member) of the first embodiment. Note that, the cutting-off of the bottom plate 100B may be performed after the impacting step or after the ironing step.

In the method of preparing a conductive support according to the first embodiment, the impacting step, the ironing step, and the blast step are sequentially performed, that is, the blast step is performed after the ironing step, and thus it is easy to control the arithmetic mean roughness Ra, the maximum height Rz, and the mean width RSm in the axial direction of the conductive support (molded cylindrical member) in the specific ranges.

Second Embodiment

The method of preparing a conductive support according to the second embodiment is a method of preparing a conductive support which includes an impacting step of pressurizing a slag containing aluminum which is disposed in a female mold by the columnar male mold so as to mold a cylindrical member by plastically deforming the slag on outer circumferential surface of the male mold, a blast step of imparting ruggedness on the outer circumferential surface of the molded cylindrical member, and an ironing step of ironing the outer circumferential surface of the cylindrical member by causing the cylindrical member, of which the ruggedness is imparted on the outer circumferential surface, to pass the inner portion of an annular pressing mold having an inner diameter which is smaller than the outer diameter of the cylindrical member, in which a conductive support formed of the cylindrical member having an arithmetic mean roughness Ra of 1.3 μm or less, a maximum height Rz of 5.0 μm or less, and an mean width RSm of from 80 μm to 400 μm is obtained.

In the preparing method, the impacting step, the blast step, and the ironing step are sequentially performed, that is, the ironing step is performed after the blast step.

In the method of preparing a conductive support according to the second embodiment, since the ironing step is performed after the blast step, the surface roughness in the blast step is uniformed by the ironing step, and thus the concavity which is the shape causing the white point is less likely to remain.

Accordingly, in the method of preparing a conductive support according to the second embodiment, the conductive support (the molded cylindrical member) which is capable of obtaining the image in which the occurrence of color point and white point is prevented is prepared.

In addition, according to the above-described preparing method, it is possible to obtain the cylindrical member (impact press tube) having the high hardness as compared with the cylindrical member prepared in the cutting step. Further, similar to the first embodiment, the coarse concave portion and the coarse convex portion are prevented from being formed, and thus it is possible to prepare the cylindrical member which has the same or greater quality (in another quality in addition to the hardness) than that of the conductive support (cylindrical member) prepared in the cutting step. With this, it is possible to omit the automatic surface inspection at the time of mass-producing the cylindrical members.

Other Embodiments

As described above, the specific embodiments of the invention have been described in detail; however, the invention is not limited thereto, and it is obvious matter for those skilled in the art that many modifications are possible within the scope of the invention.

For example, in the exemplary embodiment, the ironing is performed once, the ironing may be performed in plural times, and the diameter of the cylindrical member may be corrected in a stepwise manner.

In addition, before performing the ironing, an annealing may be performed so as to release a stress. The annealing may be performed as the post-treatment after performing the impacting.

In addition, after performing the impacting, the ironing, the blasting treatment, or the annealing, the arithmetic mean roughness Ra, the maximum height Rz, and the mean width RSm in the axial direction of the surface of the cylindrical member may be adjusted by employing a method such as an etching method, an anodizing method, a rough cutting method, a centerless grinding method, and a wet honing method.

In the exemplary embodiment, the cylindrical member 100 including the bottom plate 100B at another end portion to which one end portion 100A is opened is molded by impacting; however, the cylindrical member 100 may be molded by using other method.

In addition, in the exemplary embodiment, the columnar mold 80 is moved with respect to the pressing mold 92; however, the pressing mold 92 may be moved. That is, the columnar mold 80 and the pressing mold 92 may be relatively moved.

Further, in the exemplary embodiment, an interval is formed between the prevention surface 90A of the preventing member 86 and the outer circumferential surface of the cylindrical member 100; however, the prevention surface 90A of the preventing member 86 and the outer circumferential surface of the cylindrical member 100 may contact with each other (D4−D3=0).

Next, the electrophotographic photoreceptor according to the exemplary embodiment will be described.

Electrophotographic Photoreceptor

The electrophotographic photoreceptor according to the exemplary embodiment includes a conductive support of the exemplary embodiment and a photosensitive layer provided on the conductive support. That is, the conductive support is formed of a cylindrical member containing aluminum, and the cylindrical member has an arithmetic mean roughness Ra of 1.3 μm or less, a maximum height Rz of 5.0 μm or less, and a mean width RSm of from 80 μm to 400 μm.

Figure 12:
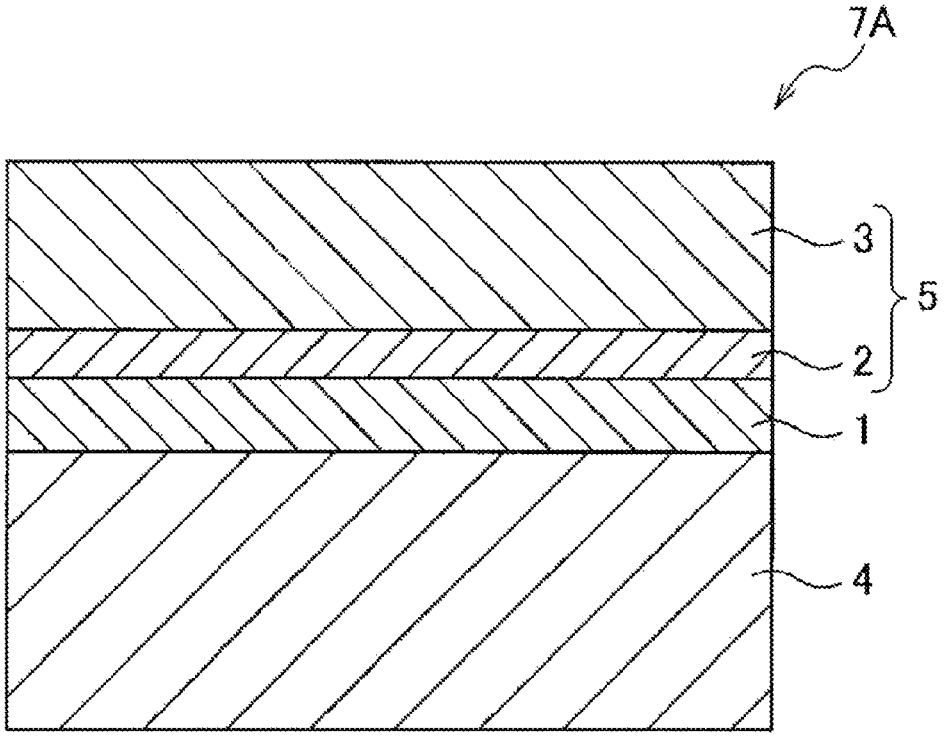
FIG. 12 is a schematic partial sectional view illustrating an example of a photoreceptor according to the exemplary embodiment.

FIG. 12 is a schematic sectional view illustrating an example of a layer configuration of an electrophotographic photoreceptor 7A. The electrophotographic photoreceptor 7A as illustrated in FIG. 12 has a structure in which the undercoat layer 1, the charge generation layer 2, and the charge transport layer 3 are sequentially laminated on the conductive support 4, and the charge generation layer 2 and the charge transport layer 3 form the photosensitive layer 5.

Figure 13:
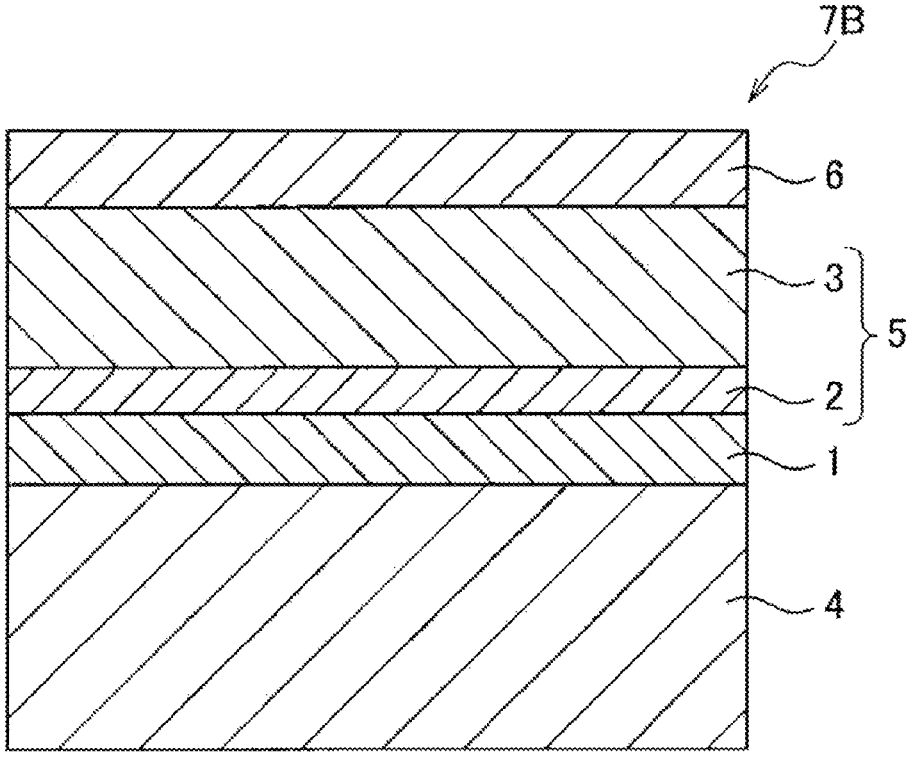
FIG. 13 is a schematic partial sectional view illustrating another example of a photoreceptor according to the exemplary embodiment.
Figure 14:
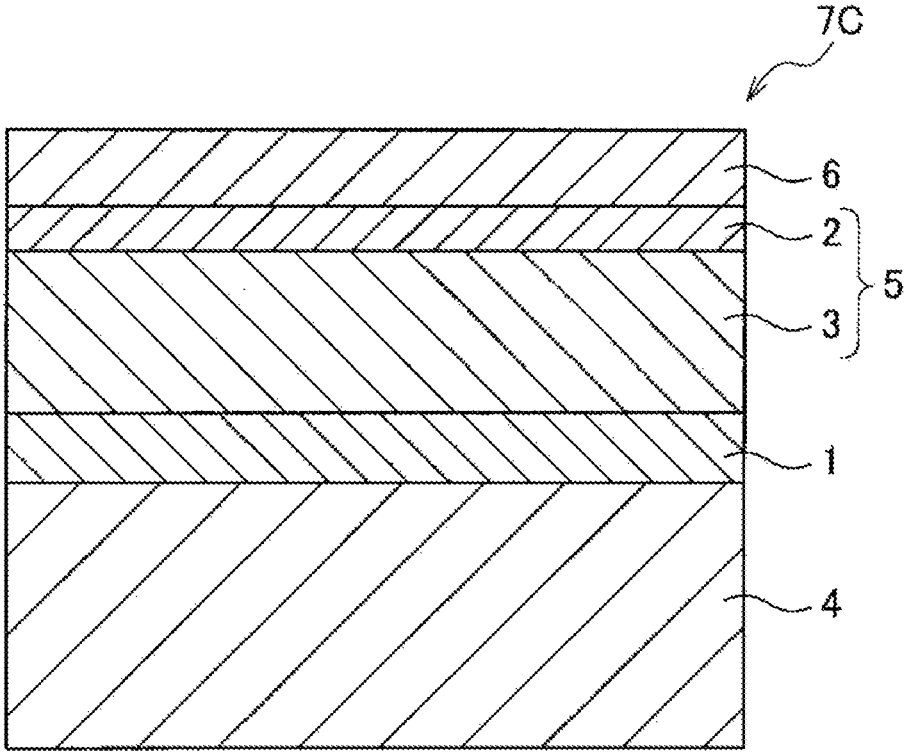
FIG. 14 is a schematic partial sectional view illustrating another example of a photoreceptor according to the exemplary embodiment.

FIG. 13 and FIG. 14 are schematic sectional views respectively illustrating another example of the layer configuration of the electrophotographic photoreceptor according to the exemplary embodiment.

Similar to the electrophotographic photoreceptor 7A illustrated in FIG. 12, the electrophotographic photoreceptors 7B and 7C illustrated in FIG. 13 and FIG. 14 include the photosensitive layer 5 of which the functions are divided into the charge generation layer 2 and the charge transport layer 3, and as a protective layer 6 is formed thereon as an outermost layer. The electrophotographic photoreceptor 7B illustrated in FIG. 13 has a structure in which the undercoat layer 1, the charge generation layer 2, the charge transport layer 3, and the protective layer 6 are sequentially laminated on the conductive support 4. The electrophotographic photoreceptor 7C illustrated in FIG. 14 has a structure in which the undercoat layer 1, the charge transport layer 3, the charge generation layer 2, and the protective layer 6 are sequentially laminated on the conductive support 4.

Note that, the undercoat layer 1 may not be necessarily provided in each of the electrophotographic photoreceptors 7A to 7C. In addition, each of the electrophotographic photoreceptors 7A to 7C is a single-layer type photosensitive layer in which functions of the charge generation layer 2 and the charge transport layer 3 are integrated may be employed.

Hereinafter, each of the layers of the electrophotographic photoreceptor will be described in detail. Note that, signs will be omitted.

Undercoat Layer

The undercoat layer a layer including, for example, an inorganic particle and a binder resin.

Examples of the inorganic particle include inorganic particles having a powder resistance (volume resistivity) in a range of from $10^2$ Ωcm to $10^{11}$ Ωcm.

Among them, as the inorganic particle having the resistance value, metal oxide particles such as tin oxide particles, titanium oxide particles, zinc oxide particles, and zirconium oxide particles may be used, and particularly, the zinc oxide particles are preferably used.

A specific surface area by a BET method of the inorganic particle may be, for example, equal to or greater than 10 $m^2/g$.

The volume average particle diameter of the inorganic particle may be, for example, in a range of from 50 nm to 2,000 nm (preferably in a range of from 60 nm to 1000 nm).

The content of the inorganic particle is, for example, is preferably in a range of from 10% by weight to 80% by weight, and is further preferably from 40% by weight to 80% by weight, with respect to the binder resin.

The inorganic particle may be subjected to the surface treatment. Two or more inorganic particles which are subjected to the surface treatment in a different way, or which have different particle diameters may be used in combination.

Examples of a surface treatment agent include a silane coupling agent, a titanate coupling agent, an aluminum coupling agent, and a surfactant. Particularly, the silane coupling agent is preferably used, and a silane coupling agent having an amino group is further preferably used.

Examples of the silane coupling agent having an amino group include 3-aminopropyl triethoxy silane, N-2-(aminoethyl)-3-aminopropyl trimethoxy silane, N-2-(aminoethyl)-3-aminopropyl methyl dimethoxy silane, and N,N-bis(2-hydroxy ethyl)-3-aminopropyl triethoxy silane; however, the silane coupling agent is not limited to these examples.

Two or more types of the silane coupling agents may be used in combination. For example, the silane coupling agent having an amino group and other silane coupling agents may be used in combination. Examples of other silane coupling agents include vinyltrimethoxysilane, 3-methacryloxypropyl-tris(2-methoxyethoxy) silane, 2-(3,4-epoxycyclohexyl)

ethyl trimethoxy silane, 3-glycidoxypropyltrimethoxysilane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, 3-chloropropyl trimethoxy silane; however, other silane coupling agents are not limited to these examples.

The method of surface treatment by using the surface treatment agent is not limited as long as it is a well-known method, and a drying method or a wet method may be used.

The amount of the surface treatment agent is, for example, preferably from 0.5% by weight to 10% by weight with respect to the inorganic particle.

Here, the undercoat layer may include an inorganic particle and an electron-accepting compound (acceptor compound) from the viewpoint that long-term stability of electrical characteristics and the carrier blocking properties are improved.

Examples of the electron-accepting compound include an electron transporting substance, for example, a quinone compound such as chloranil and Buromaniru; a tetracyanoquinodimethane compound; a fluorenone compound such as 2,4,7-trinitrofluorenone, 2,4,5,7-tetranitro-9-fluorenone; an oxadiazole compound such as 2-(4-biphenyl)-5-(4-t-butyl phenyl)-1,3,4-oxadiazole, 2,5-bis(4-naphthyl)-1,3,4-oxadiazole, 2,5-bis(4-diethyl amino-phenyl)-1,3,4-oxadiazole; a xanthone compound; a thiophene compound; and a diphenoquinone compound such as 3,3',5,5' tetra-t-butyl diphenoquinone.

Particularly, as the electron-accepting compound, a compound having an anthraquinone structure is preferably used. As the compound having an anthraquinone structure, for example, a hydroxyanthraquinone compound, an amino anthraquinone compound, and an amino hydroxy anthraquinone compound are preferably used, and specifically, anthraquinone, alizarin, quinizarin, anthrarufin, and purpurin are preferably used.

The electron-accepting compound may be dispersed in the undercoat layer together with the inorganic particle, or may be attached on the surface of the inorganic particle.

Examples of the method of attaching the electron-accepting compound on the surface of the inorganic particle include a drying method and a wet method.

The drying method is a method of attaching the electron-accepting compound to the surface of the inorganic particle, for example, the electron-accepting compound or the electron-accepting compound which is dissolved in the organic solvent is added dropwise, and is sprayed with dry air or nitrogen gas while stirring the inorganic particle by using a large mixer having a shear force. The electron-accepting compound may be added dropwise or sprayed at a temperature below the boiling point of the solvent. After the electron-accepting compound is added dropwise or sprayed, sintering may be performed at a temperature of equal to or greater than 100° C. The sintering is not particularly limited as long as a temperature and time for obtaining the electrophotographic properties are provided.

The wet method is a method of attaching the electron-accepting compound to the surface of the inorganic particle by removing the solvent after the electron-accepting compound is added and stirred or dispersed while dispersing the inorganic particles in the solvent through a stirrer, ultrasound, a sand mill, an attritor, a ball mill, and the like. As a method of removing a solvent, for example, the solvent is distilled off by filtration or distillation. After removing the solvent, sintering may be performed at a temperature of equal to or greater than 100° C. The sintering is not particularly limited as long as a temperature and time for obtaining the electrophotographic properties are provided. In the wet method, the water content of the inorganic particle may be removed before adding the electron-accepting compound, and examples thereof includes a method of removing the water content of the inorganic particle while stirring and heating in the solvent, and a method of removing the water content of the inorganic particle by forming an azeotrope with the solvent.

Note that, attaching the electron-accepting compound may be performed before or after performing the surface treatment on the inorganic particle by using a surface treatment agent, and the attaching of the electron-accepting compound and the surface treatment by using a surface treatment agent may be concurrently performed.

The content of the electron-accepting compound may be from 0.01% by weight to 20% by weight, and is preferably from 0.01% by weight to 10% by weight with respect to the inorganic particle.

Examples of the binder resin used for the undercoat layer include a well-known polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, an urea resin, a phenol resin, a phenol-formaldehyde resin, a melamine resin, an urethane resin, an alkyd resin, and an epoxy resin; a zirconium chelate compound; a titanium chelate compound; an aluminum chelate compound; a titanium alkoxide compound; an organic titanium compound; and a well-known material such as an a silane coupling agent.

Examples of the binder resin used for the undercoat layer include a charge transport resin having a charge transport group, and a conductive resin (for example, polyaniline).

Among them, as the binder resin used for the undercoat layer, an insoluble resin in the coating solvent for the upper layer is preferably used. Particularly, examples thereof include a thermosetting resin such as an urea resin, a phenol resin, a phenol-formaldehyde resin, a melamine resin, a urethane resin, an unsaturated polyester resin, an alkyd resin, and an epoxy resin; and a resin obtained by reaction of at least one resin selected from the group consisting a polyamide resin, a polyester resin, a polyether resin, a methacrylic resin, an acrylic resin, a polyvinyl alcohol resin, and a polyvinyl acetal resin, and a curing agent.

In a case where two or more binder resins are used in combination, the mixing ratio thereof is set if necessary.

The undercoat layer may contain various types of additives so as to improve electrical properties, environmental stability, and image quality.

Examples of the additive include well-known materials, for example, an electron transporting pigment such as a polycyclic condensed pigment and an azo pigment, a zirconium chelate compound, a titanium chelate compound, an aluminum chelate compound, a titanium alkoxide compound, an organic titanium compound, and a silane coupling agent. The silane coupling agent is used for the surface treatment of the inorganic particle as described above, and may be also added to the undercoat layer as an additive.

Examples of the coupling agent as an additive include vinyl trimethoxy silane, 3-methacryloxy propyl-tris(2-methoxyethoxy)silane, 2-(3,4-epoxycyclohexyl)ethyl trimethoxy silane, 3-glycidoxypropyltrimethoxysilane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl methoxy silane, N,N-bis(2-hydroxyethyl)-3-aminopropyltri ethoxy silane, and 3-chloro-propyl trimethoxy silane.

Examples of the zirconium chelate compound include zirconium butoxide, zirconium ethyl acetoacetate, zirconium triethanolamine, acetylacetonate zirconium butoxide, acetoacetic acid ethyl zirconium butoxide, zirconium acetate, zirconium oxalate, zirconium lactate, zirconium phosphonate, zirconium octane acid, naphthenic acid zirconium, zirconium lauric acid, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, poly titanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris (ethyl acetoacetate).

The above-described additives may be used alone or may be used as a mixture of plural compounds or polycondensate.

The Vickers' hardness of the undercoat layer may be equal to or greater than 35.

In order to prevent the occurrence of moire images, the surface roughness (ten-point height of roughness profile) of the undercoat layer may be adjusted to ½ to 1/(4n) (n is the refractive index of the upper layer) of the using exposure laser wavelength λ.

The resin particle or the like may be added into the undercoat layer so as to adjust the surface roughness. Examples of the resin particle include a silicone resin particle, and a crosslinked polymethyl methacrylate resin particle. In addition, the surface of the undercoat layer may be polished so as to adjust the surface roughness. Examples of a polishing method include a buffing method, a sandblasting method, a wet honing method, and a grinding method.

The forming of the undercoat layer is not particularly limited, and a well-known forming method is used. For example, the method is performed in such a manner that a coated film coated with the coating liquid for forming an undercoat layer to which the above-described components are added as a solvent is coated, dried, and then heated if necessary.

Examples of the solvent for preparing the coating liquid for forming an undercoat layer include a well-known organic solvent such as an alcohol solvent, an aromatic hydrocarbon solvent, a halogenated hydrocarbon solvent, a ketone solvent, a ketone alcohol solvent, an ether solvent, and an ester solvent.

Specific examples of the solvent include general organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A method of dispersing inorganic particles at the time of preparing the coating liquid for forming an undercoat layer includes a well-known method by using a roll mill, a ball mill, a vibrating ball mill, an attritor, a sand mill, a colloid mill, and a paint shaker.

Examples of the method of coating the conductive support with the coating liquid for forming an undercoat layer include a general method such as a blade coating method, a wire-bar coating method, a spray coating method, a dip coating method, a bead coating method, an air knife coating method, and a curtain coating method.

The thickness of the undercoat layer is preferably set to be equal to or greater than 15 μm, and is further preferably set to be from 20 μm to 50 μm, for example.

Intermediate Layer

Although not shown in the drawings, an intermediate layer may be further provided between the undercoat layer and the photosensitive layer.

The intermediate layer is a layer including a resin. Examples of the resin used for the intermediate layer include a polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a chloride vinyl-vinyl acetate-maleic anhydride resin, a silicone resin, a silicone-alkyd resin, a phenol-formaldehyde resin, and a melamine resin.

The intermediate layer may be a layer including an organometallic compound. Examples of the organometallic compound used for the intermediate layer include an organometallic compound containing a metal atom such as zirconium, titanium, aluminum, manganese, and silicon.

The compounds used for the intermediate layer may be used alone, or may be used as a mixture of plural compounds or a polycondensate.

Among them, the intermediate layer is preferably a layer including an organometallic compound containing a zirconium atom or a silicon atom.

The forming of the intermediate layer is not particularly limited, and a well-known forming method is used. For example, the method is performed in such a manner that a coated film coated with the coating liquid for an intermediate layer to which the above-described components are added as a solvent is coated, dried, and then heated if necessary.

Examples of a coating method for forming an intermediate layer include a dip coating method, a push-up coating method, a wire-bar coating method, a spray coating method, a blade coating method, a knife coating method, and a curtain coating method.

The thickness of intermediate layer is preferably set in a range of from 0.1 μm to 3 μm, for example. Note that, the intermediate layer may be used as an undercoat layer.

Charge Generation Layer

The charge generation layer includes, for example, a charge generation material and a binder resin. In addition, the charge generation layer may be a deposited layer of the charge generation material. The deposited layer of the charge generation material is preferably used in a case where a non-coherent light source such as a light emitting diode (LED), organic electro-luminescence (EL) image array.

Examples of the charge generation material include an azo pigment such as bisazo and trisazo; a condensed ring aromatic pigment such as dibromoanthanthrone; a perylene pigment; a pyrrolopyrrole pigment; phthalocyanine pigment; zinc oxide; and trigonal selenium.

Among them, in order to correspond to the laser exposure in the near infrared region, a metal phthalocyanine pigment, or a non-metal phthalocyanine pigment are preferably used as the charge generation material. Specific examples thereof include hydroxygallium phthalocyanine, chlorogallium phthalocyanine, dichlorotin phthalocyanine, and titanyl phthalocyanine.

On the other hand, in order to correspond to the laser exposure in the near ultraviolet region, a condensed ring aromatic pigment such as dibromoanthanthrone; a thioindigo pigment; a porphyrazine compound; zinc oxide; trigonal selenium; and a bisazo pigment are preferably used as the charge generation material.

In a case of using the non-coherent light source such as LED and the organic EL image array, which have a central wavelength falling within the range of from 450 nm to 780 nm, the above charge generation material may be used; however, in terms of the resolution, when a photosensitive layer having a thickness of 20 μm or less is used, the electric field strength is enhanced in the photosensitive layer, and due to the charge injection from the substrate, an image defect which is so-called "black dot" is likely to occur. This phenomenon is remarkable in the use of a charge generation material which easily causes a dark current in a p-type semiconductor such as trigonal selenium and a phthalocyanine pigment.

In contrast, in a case of using a n-type semiconductor such as a condensed ring aromatic pigment, a perylene pigment, and an azo pigment as the charge generation material, the dark current is less likely to occur and the image defect which is the so-called dark dot may be prevented even with thin film. As the n-type charge generation material, for example, compounds (CG-1) to (CG-27) disclosed in paragraphs [0288] to of JP-A-2012-155282 are exemplified; however, the example thereof is not limited thereto.

Note that, the determination of the n-type is performed by polarity of flowing photocurrent with a time-of-flight method which is generally used, and a material which causes electrons to easily flow as carriers as compared with a hole is set as a n-type.

The binder resin used for the charge generation layer is selected from the insulating resins in a wide range, and the binder resin may be selected from organic photoconductive polymers such as poly-N-vinylcarbazole, polyvinyl anthracene, polyvinyl pyrene, and polysilanes.

Examples of the binder resin include a polyvinyl butyral resin, a polyarylate resin (a polycondensate of bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinyl pyrrolidone resin. Here "insulation properties" mean a case where the volume resistivity is equal to or greater than $10^{13}$ Ωcm.

These binder resins may be used alone or two or more types thereof may be used in combination.

Note that, the mixing ration of the charge generation material to the binder resin is preferably from 10:1 to 1:10 by the weight ratio.

The charge generation layer may include other well-known additives.

The charge generation layer is not particularly limited, and a well-known forming method is used. For example, the method is performed in such a manner that a coated film coated with the coating liquid for forming a charge generation layer to which the above-described components are added as a solvent is coated, dried, and then heated if necessary. Note that, the forming of the charge generation layer may be performed by vaporizing the charge generation material. The forming of the charge generation layer performed by vaporizing the charge generation material is particularly preferable in a case where a condensed aromatic pigment and a perylene pigment are used as the charge generation material.

Examples of the solvent for preparing coating liquid for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or two or more type thereof are used in combination Examples of a method of dispersing the particles (for example, charge generation material) in the coating liquid forming a charge generation layer include a method by using a media dispersing machine such as a ball mill, a vibrating ball mill, an attritor, a sand mill, and a horizontal sand mill, and a media-less disperser such as a stirrer, an ultrasonic disperser, a roll mill, and a high pressure homogenizer. Examples of the high-pressure homogenizer include a collision-type homogenizer in which a dispersion is dispersed by liquid-liquid collision, and liquid-wall collision under high pressure, and a passing-through-type homogenizer in which a dispersion is dispersed by passing the dispersion through thin flow paths under high pressure.

Note that, at the time of this dispersion, the average particle diameter of the charge generation material in the coating liquid forming a charge generation layer is equal to or less than 0.5 μm, is preferably equal to or less than 0.3 μm, and further preferably equal to or less than 0.15 μm.

Examples of a method of coating the undercoat layer (or on the intermediate layer) with the coating liquid forming a charge generation layer include a general method such as a blade coating method, a wire-bar coating method, a spray coating method, a dip coating method, a bead coating method, an air knife coating method, and a curtain coating method.

The thickness of the charge generation layer is preferably set to be from 0.1 μm to 5.0 μm, and is further preferably set to be from 0.2 μm to 2.0 μm, for example.

Charge Transport Layer

The charge transport layer is, for example, a layer including a charge transport material and a binder resin. The charge transport layer may be a layer including a polymer charge transport material.

Examples of the charge transport material include an electron transporting compound such as a quinone compound such as p-benzoquinone, chloranil, Buromaniru, and anthraquinone; a tetracyanoquinodimethane compound; a fluorenone compound such as 2,4,7-trinitrofluorenone; a xanthone compound; a benzophenone compound; and a cyanovinyl compound; an ethylene compound. Examples of the charge transport material include a hole-transporting compound such as a triarylamine compound, a benzidine compound, an arylalkane compound, an aryl substituted ethylene compound, a stilbene compound, an anthracene compound, and a hydrazone compound. These charge transport materials may be used alone or two or more types thereof may be used, but are not limited thereto.

As the charge transport material, in terms of charge mobility, a triarylamine derivative expressed by the following formula (a-1) and a benzidine derivative expressed by the following formula (a-2) are preferably used.

(a-1)

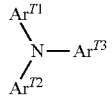

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of the respective groups include a halogen atom, an alkyl group having from 1 to 5 carbon atoms, and an alkoxy group having from 1 to 5 carbon atoms. In addition, examples of the substituent of the respective groups include a substituted amino group which is substituted with an alkyl group having from 1 to 3 carbon atoms.

(a-2)

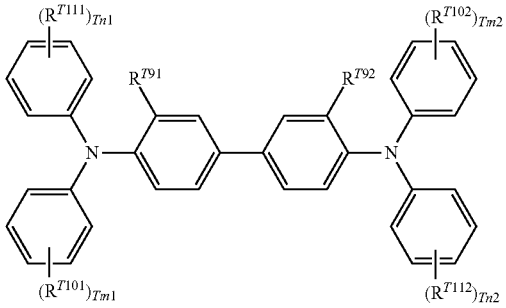

In the formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$ and $R^{T112}$ each independently represent a halogen atom, an alkyl group having from 1 to 5 carbon atoms, an alkoxy group having from 1 to 5 carbon atoms, an amino group which is substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer of from 0 to 2.

Examples of the substituent of the respective groups include a halogen atom, an alkyl group having from 1 to 5 carbon atoms, and an alkoxy group having from 1 to 5 carbon atoms. In addition, examples of the substituent of the respective groups include a substituted amino group which is substituted with an alkyl group having from 1 to 3 carbon atoms.

Here, among a triarylamine derivative expressed by the formula (a-1) and a benzidine derivative expressed by the formula (a-2), a triarylamine derivative having "$—C_6H_4—CH=CH—CH=C(R^{T7})(R^{T8})$", and a benzidine derivative having "$—CH=CH—CH=C(R^{T15})(R^{T16})$" are particularly preferable in terms of the charge mobility.

As the polymer charge transport material, a material having charge transporting properties such as poly-N-vinylcarbazole and polysilane is used. Particularly, a polyester polymer charge transport material is particularly preferable. Note that, the polymer charge transport material may be used alone, or may be used in combination with the binder resin.

Examples of the binder resin used for the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among them, as the binder resin, the polycarbonate resin and the polyarylate resin are preferably used. These binder resins may be used alone or two or more types thereof may be used in combination.

Note that, the mixing ratio of the charge transport material to the binder resin is 10:1 to 1:5 by the weight ratio.

The charge transport layer may include other well-known additives.

The charge transport layer is not particularly limited, and a well-known forming method is used. For example, the method is performed in such a manner that a coated film coated with the coating liquid for forming a charge transport layer to which the above-described components are added as a solvent is coated, dried, and then heated if necessary.

Examples of the solvent for preparing the coating liquid forming a charge transport layer includes general organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or two or more types thereof may be used in combination.

Examples of the method of coating the charge generation layer with the coating liquid for forming a charge transport layer include a general method such as a blade coating method, a wire-bar coating method, a spray coating method, a dip coating method, a bead coating method, an air knife coating method, and a curtain coating method.

The thickness of the charge transport layer is, for example, preferably set to be from 5 μm to 50 μm, and is further preferably set to be from 10 μm to 30 μm.

Protective Layer

The protective layer is provided on the photosensitive layer if necessary. For example, the protective layer is provided so as to prevent the photosensitive layer during charge from being chemically changed, or to further enhance the technical strength of the photosensitive layer.

For this reason, the protective layer may employ a layer formed of a cured film (a cross-linked membrane). Examples of these layers include layers described in the following description 1) or 2).

1) A layer which is formed of a cured film of a composition including a reactive group-containing charge transport material having a reactive group and a charge transport skeleton in the same molecule (that is, a layer including a polymer or a crosslinked polymer of the reactive group-containing charge transport material)

2) A layer which is formed of a cured film of a composition including a non-reactive charge transport material and a reactive group-containing non-charge transport material having a reactive group without a charge transport skeleton (that is, a layer including a polymer or crosslinked polymer a non-reactive charge transport material and the reactive group-containing non-charge transport material)

Examples of the reactive group of the reactive group-containing charge transport material include well-known reactive groups such as a chain polymerization group, an epoxy group, —OH, —OR (where R represents an alkyl group), —$NH_2$, —SH, —COOH, and —$SiR^{Q1}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain polymerization group is not particularly limited as long as it is a functional group capable of radical polymerization, and examples thereof include a functional group having a group containing at least carbon double bond. Specific examples thereof include a group containing at least one selected from a vinyl group, a vinyl ether group, a vinyl thioether group, a styryl group (vinyl phenyl), an acryloyl group, a methacryloyl group, and derivatives thereof. Among them, in terms of excellent reactivity, a group containing at least one selected from a vinyl group, a styryl group (vinyl phenyl), an acryloyl group, a methacryloyl group, and the derivatives thereof is preferably used as the chain polymerization group.

The charge transport skeleton of the reactive group-containing charge transport material is not particularly limited as long as it is a well-known structure in the electrophotographic photoreceptor. For example, a skelton derived from a nitrogen-containing hole transport compound such as a triarylamine compound, a benzidine compound, and a hydrazone compound is used, and examples thereof include a structure is conjugated a nitrogen atom. Among them, the triarylamine skeleton is preferably used.

The reactive group-containing charge transport material having the reactive group and the charge transport skeleton, the non-reactive charge transport material, and the reactive group-containing charge transport material may be selected from well-known materials.

The protective layer may include other well-known additives.

The forming of the protective layer is not particularly limited, and a well-known forming method is used. For example, the method is performed in such a manner that a coated film coated with the coating liquid for forming a protective layer to which the above-described components are added as a solvent is coated, dried, and then heated if necessary.

Examples of the solvent for preparing the coating liquid for forming a protective layer an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; and an alcohol solvent such as isopropyl alcohol and butanol. These solvents may be used alone or two or more types thereof may be used in combination.

Note that, the coating liquid for forming a protective layer may be a coating liquid of an inorganic solvent.

Examples of the method of coating the photosensitive layer (for example, a charge transport layer) with the coating liquid for forming a protective layer include a dip coating method, a push-up coating method, a wire-bar coating method, a spray coating method, a blade coating method, a knife coating method, and a curtain coating method.

The thickness of the protective layer is preferably from 1 μm to 20 μm, and further preferably from 2 μm to 10 μm.

Single Layer-Type Photosensitive Layer

The single layer-type photosensitive layer (a charge generation or a charge transport layer) is a layer including, for example, a charge generation material and a charge transport material, and a binder resin and other well-known additives if necessary. Note that, these materials are the same as those in the description of the charge generation layer and the charge transport layer.

In addition, in the single layer-type photosensitive layer, the content of the charge generation material may be from 10% by weight to 85% by weight, and is further preferably from 20% by weight to 50% by weight with respect to the entire solid content. In addition, in the single layer-type photosensitive layer, the content of the charge transport material may be from 5% by weight to 50% by weight with respect to the entire solid content.

The method of forming the single layer-type photosensitive layer is the same as the method of forming the charge generation layer or the charge transport layer.

The thickness of the single layer-type photosensitive layer is, for example, from 5 μm to 50 μm, and is further preferably from 10 μm to 40 μm.

Image Forming Apparatus (and Process Cartridge)

The image forming apparatus according to the exemplary embodiment includes the electrophotographic photoreceptor according to the exemplary embodiment, a charging unit that charges a surface of the electrophotographic photoreceptor, an electrostatic latent image forming unit that forms an electrostatic latent image on the charged surface of the electrophotographic photoreceptor, a developing unit that forms a toner image by developing the electrostatic latent image formed on the surface of the electrophotographic photoreceptor by using a developer containing a toner, and a transfer unit that transfers the toner image to a surface of a recording medium. In addition, as the electrophotographic photoreceptor, the electrophotographic photoreceptor according to the exemplary embodiment is employed.

As the image forming apparatus according to the exemplary embodiment, well-known image forming apparatuses such as an apparatus including fixing unit that fixes a toner image transferred on a surface of a recording medium; a direct-transfer type apparatus that directly transfers the toner image formed on the surface of the electrophotographic photoreceptor to the recording medium; an intermediate transfer type apparatus that primarily transfers the toner image formed on the surface of the electrophotographic photoreceptor to a surface of an intermediate transfer member, and secondarily transfers the toner image transferred to the intermediate transfer member to the surface of the recording medium; an apparatus including a cleaning unit that cleans the surface of the electrophotographic photoreceptor before being charged and after transferring the toner image; an apparatus includes an erasing unit that erases charges by irradiating the electrophotographic photoreceptor with erasing light before being charged and after transferring the toner image; and an apparatus including an electrophotographic photoreceptor heating member that increase the temperature of the electrophotographic photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the electrophotographic photoreceptor toner image to the surface of the intermediate transfer member, and a secondary transfer unit that secondarily transfers the toner image formed on the surface of the intermediate transfer member to the surface of the recording medium.

The image forming apparatus according to the exemplary embodiment may be any type of a dry developing type image forming apparatus and a wet developing type (developing type using a liquid developer) image forming apparatus.

Note that, in the image forming apparatus according to the exemplary embodiment, for example, a unit including the electrophotographic photoreceptor may be a cartridge structure (process cartridge) detachable from the image forming apparatus. As a process cartridge, for example, a process cartridge including the electrophotographic photoreceptor according to the exemplary embodiment is preferably used. In addition, in addition to the electrophotographic photoreceptor, at least one selected from the group consisting of a charging unit, an electrostatic latent image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

Figure 15:
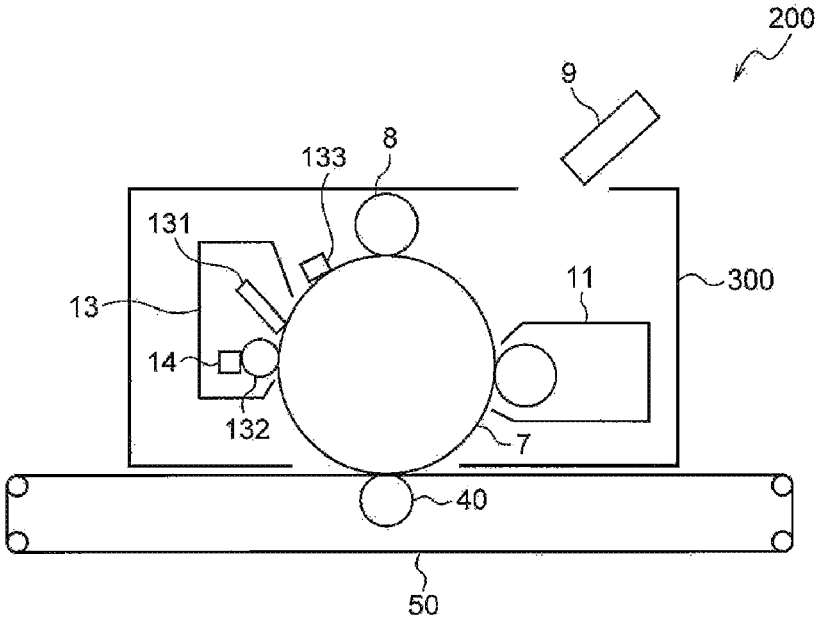
FIG. 15 is a schematic configuration illustrating an example of an image forming apparatus according to the exemplary embodiment.

FIG. 15 is a schematic configuration illustrating an example of the image forming apparatus according to the exemplary embodiment.

As illustrated in FIG. 15, an image forming apparatus 200 according to the exemplary embodiment includes a process cartridge 300 which is provided with an electrophotographic photoreceptor 7, an exposure device 9 (an example of the electrostatic latent image forming unit), a transfer device (an example of the primary transfer device), and an intermediate transfer member 50. In addition, in the image forming apparatus 200, the exposure device 9 is disposed at a position so as to expose the electrophotographic photoreceptor 7 from an opening of the process cartridge 300, the transfer device 40 is disposed at a position facing the electrophotographic photoreceptor 7 via the intermediate transfer member 50, and the intermediate transfer member 50 is disposed such that a portion thereof contacts the electrophotographic photoreceptor 7. Although not shown, the image forming apparatus 200 also includes a secondary transfer device that transfers the toner image which is transferred to the intermediate transfer member 50 to a recording medium (for example, recording sheet). Note that, the intermediate transfer member 50, the transfer device 40 (the primary transfer device), and the secondary transfer device (not shown) correspond to examples of the transfer unit.

The process cartridge 300 in FIG. 15 integrally supports an electrophotographic photoreceptor 7, a discharging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, the cleaning blade 131 is disposed so as to contact the surface of the electrophotographic photoreceptor 7. Note that, the cleaning member is not limited to the cleaning blade 131, and may be a conductive or an insulating fibrous member, which may be used alone or used in combination with the cleaning blade 131.

Meanwhile, FIG. 15 illustrates an example of the image forming apparatus including a fibrous member 132 (roller shape) for supplying a lubricant 14 to the surface of the electrophotographic photoreceptor 7, and a fibrous member 133 (flat brush) for assisting the cleaning step, and the above members are disposed in accordance with the use.

Hereinafter, the respective configurations of the image forming apparatus according to the exemplary embodiment will be described.

Discharging Device

Examples of the discharging device 8 include a contact-type charging device using a conductive or a semi conductive charging roller, a charging brush, a charging film, a charging rubber blade, and a charging tube. In addition, well-known discharging devices per se such as a non-contact type roller charging device, a scorotron charging device using corona discharge and a corotron charging device are also used.

Exposure Device

Examples of the exposure device 9 include an optical device that exposes the light such as a semiconductor laser beam, LED light, and liquid crystal shutter light to a determined image on the surface of the electrophotographic photoreceptor 7. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm or laser having the oscillation wavelength in a range of from 400 nm to 450 nm as a blue laser may be also used. In addition, a surface emission-type laser light source capable of outputting a multi-beam is also effective to form a color image.

Developing Device

Examples of the developing device 11 include a general developing device that contacts or non-contacts a developer so as to develop an image. The developing device 11 is not particularly limited as long as it has the above-described function, and is selected on the purpose. For example, a well-known developing device having a function of attaching a one component developer or a two-component developer to the electrophotographic photoreceptor 7 by using a brush, a roller, or the like may be exemplified. Among them, a developing roller holding the developer on the surface is preferably used.

The developer used for the developing device 11 may be a one component developer containing only a toner or may be a two-component developer containing a toner and a carrier. In addition, the developer may be magnetic or non-magnetic. As the developer, well-known developers are used.

Cleaning Device

As the cleaning device 13, a cleaning blade-type device including a cleaning blade 131 is used.

Note that, in addition to the cleaning blade-type device, a fur brush cleaning device and a simultaneous developing and cleaning device may be also employed.

Transfer Device

Examples of the transfer device 40 include well-known transfer device per se such as a contact type transfer device using a belt, a roller, a film, a rubber blade, and the like, a scorotron charging device using corona discharge, and a corotron charging device are also used.

Intermediate Transfer Member

Examples of the intermediate transfer member 50 include a belt-type member (an intermediate transfer belt) containing polyimide, polyamideimide, polycarbonate, polyarylate, polyester, rubber, and the like to which semi conductivity is imparted. In addition, the shape of the intermediate transfer member may be a drum in addition to the belt shape.

Figure 16:
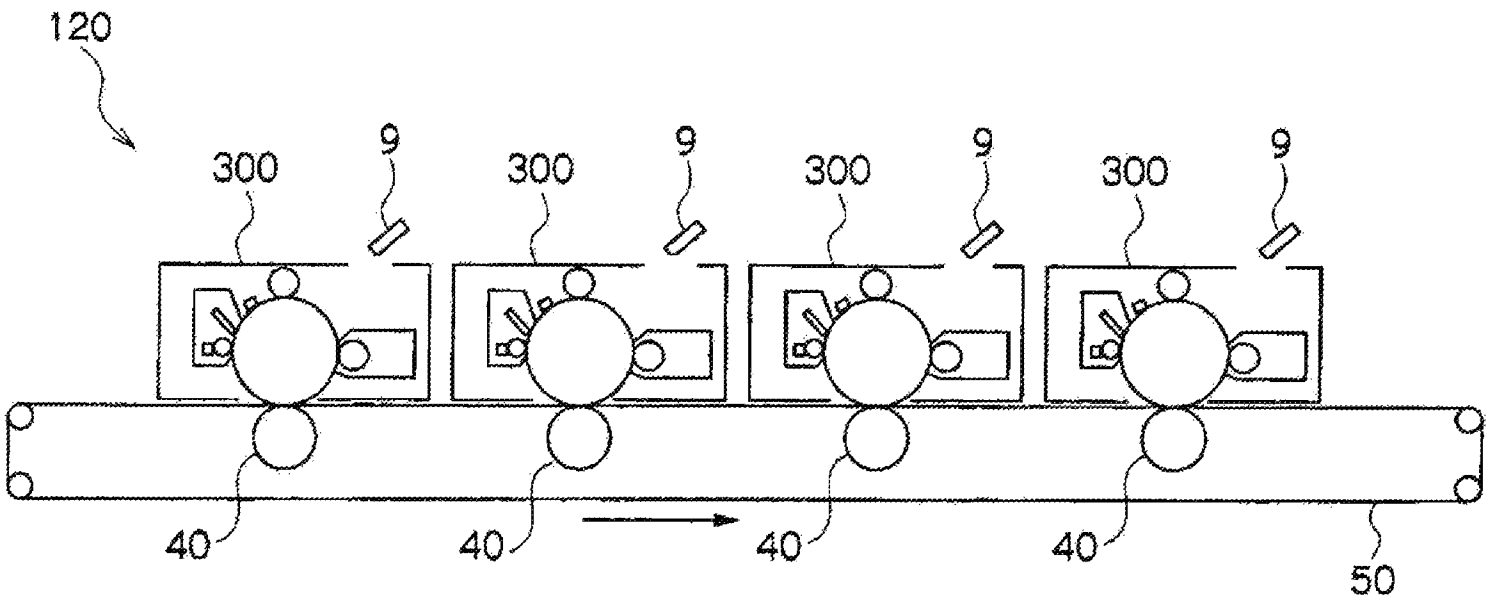
FIG. 16 is a schematic configuration illustrating another example of an image forming apparatus according to the exemplary embodiment.

FIG. 16 is a schematic configuration illustrating another example of an image forming apparatus according to the exemplary embodiment.

The image forming apparatus 120 illustrated in FIG. 16 is a tandem type multi-color image forming apparatus including four process cartridges 300. In the image forming apparatus 120, the four process cartridges 300 are arranged in parallel on the intermediate transfer member 50, and one electrophotographic photoreceptor is used for one color. Note that, the image forming apparatus 120 has a configuration which is the same as that of the image forming apparatus 200 except that it is a tandem type image forming apparatus.

EXAMPLES

Hereinafter, Examples of the present invention will be described; however, the invention is not limited to the following Examples. In the following description, unless specifically noted, "parts" and "%" are based on the weight.

Preparation of Conductive Support

Preparation of Conductive Support (1)

An aluminum plate in which a thickness 15 mm of an aluminum alloy (JIS 1050) having the aluminum purity of equal to or greater than 99.5% is punched so as to prepare an aluminum columnar slag having a diameter of 34 mm and a thickness of 15 mm. A lubricant is imparted to the slag, and then impacting is performed so as to mold a cylindrical member having a diameter of 34 mm.

Subsequently, a blasting treatment is perform under the following conditions, and ironing is performed once, thereby preparing an aluminum conductive support (1) (cylindrical member) having a diameter of 30 mm, a length of 251 mm, and a thickness of 0.8 mm.

A polishing (media) material for condition of the blasting treatment: zirconia, size of the polishing material: 60 μm, irradiation pressure of the polishing material: 0.15 MPa, and irradiation time of the polishing material: 30 seconds Preparation of Conductive Supports (2) to (19), (1C) to (5C), (7C), and (8C)

The conductive supports (2) to (19), (1C) to (5C), (7C), (8C), and (9C) are prepared by using the same method as that used in the conductive support (1) except that as indicated in Table 1 and Table 2, the conditions for blasting treatment (the irradiation pressure of the polishing material, the irradiation time of the polishing material, and the order of steps) is changed in the preparing of the conductive support (1).

Preparation of Conductive Support (20)

The aluminum conductive support (20) having a diameter of 30 mm, a length of 300 mm, and a thickness of 0.5 mm is prepared by cutting a surface of an aluminum cylindrical tube (a tube material) prepared by using a conventional drawn tube.

Preparation of Conductive Support (6C)

The conductive support (6C) (cylindrical member) is prepared by using the same method as that used in the conductive support (1) except that a slag which is scratched in advance is used, and the blasting treatment is not performed.

Properties of Conductive Support

Regarding the conductive supports (1) to (20), and (1C) to (8C), an arithmetic mean roughness Ra, a maximum height of roughness profile Rz, a mean width RSm in the axial direction, and a surface hardness (Vickers hardness) are measured by using a conventional method. The results are indicated in Tables 1 and 2.

Preparation of Photoreceptor

Preparation of Photoreceptor (1)

100 parts by weight of zinc oxide (product name: MZ300, manufactured by Tayca Co., Ltd,), 10 parts by weight of toluene solution having 10% by weight of N-2-(aminoethyl)-3-aminopropyl triethoxysilane as a silane coupling agent, and 200 parts by weight toluene are mixed and stirred, and then the mixture is circulated for 2 hours. After that, the toluene is distilled under the reduced pressure at 10 mmHg, and is sintered at 135° C. for 2 hours, thereby performing the surface treatment on zinc oxide by using a silane coupling agent.

33 parts by weight of surface treated zinc oxide, 6 parts by weight of blocked isocyanate (product name: SUMIDUR 3175, manufactured by Sumitomo Bayer Urethane Co., Ltd), 1 part by weight of compound expressed by the following formula (AK-1), and 25 parts by weight of methyl ethyl ketone are mixed with each other for 30 minutes, and thereafter, 5 parts by weight of butyral resin (product name: S-LEC BM-1, manufactured by SEKISUI CHEMICAL CO., LTD.,), 3 parts by weight of silicone ball (product name: TOSPEARL 120, manufactured by Momentive Performance Materials Inc.), and 0.01 parts by weight of silicone oil as a leveling agent (product name: SH29PA, manufactured by Dow Corning Toray Silicone Co., Ltd) are mixed with each other, and then the mixture is dispersed for 3 hours by using a sand mill, thereby obtaining a coating liquid for forming an undercoat layer.

Further, the conductive support (1) prepared as described above is coated with the coating liquid for forming an undercoat layer by using a dip coating method, and then dried and cured at 180° C. for 30 minutes, thereby obtaining an undercoat layer having a thickness of 30 μm.

(AK-1)

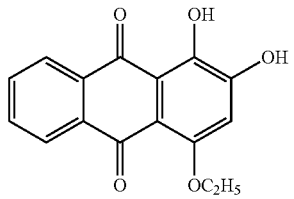

Next, a hydroxygallium phthalocyanine pigment [a V-type hydroxygallium phthalocyanine pigment having diffraction peaks at points where Bragg angles (2θ±0.2°) of an X-ray diffraction spectrum using the CuKα characteristic X-ray are least 7.3°, 16.0°, 24.9°, and 28.0° (the maximum peak wavelength in the spectral absorption spectrum within wavelength range of from 600 nm to 900 nm is 820 nm, the average particle diameter is 0.12 μm, the maximum particle size is 0.2 μm, and the specific surface area value is 60 $m^2/g$)] as the charge generation material, a vinyl chloride-vinyl acetate copolymer resin (product name: VMCH, Manufactured by Nippon Unicar Co., Ltd.) as the binder resin, and the mixture formed of n-butyl acetate are put into a glass bottle having a capacity of 100 mL together with galas beads of 1.0 mmφ at a 50% filling rate, and a dispersion treatment is performed for 2.5 hours by using a paint shaker, thereby obtaining a coating liquid for forming a charge generation layer. The content of the hydroxygallium phthalocyanine pigment is set to be 55.0% by volume, and the solid content of the dispersion is set to be 6.0% by weight, with respect to the mixture of the hydroxygallium phthalocyanine pigment and the vinyl chloride-vinyl acetate copolymer resin. The content is calculated by setting the specific gravity of the hydroxygallium phthalocyanine pigment to be 1.606 g/cm$^3$, and the specific gravity of the vinyl chloride-vinyl acetate copolymer resin to be 1.35 g/cm$^3$.

The undercoat layer is impregnated and coated with the obtained coating liquid forming a charge generation layer, and dried at 130° C. for 5 minutes, thereby forming a charge generation layer having a thickness of 0.20 μm.

Next, 8 parts by weight of butadiene charge transport material (CT1A) and parts by weight of benzidine charge transport material (CT2A) 32 as the charge transport material, and 58 parts by weight of bisphenol Z-type polycarbonate resin (homopolymer type polycarbonate resin of bisphenol Z, and the viscosity-average molecular weight: 40,000) as the binder resin, 2 parts by weight (5% by weight with respect to total 100% by weight of the charge transport material) of hindered phenol antioxidant (HP-1, molecular weight 775) as the antioxidant are added and dissolved into 340 parts by weight of tetrahydrofuran, and thereby the coating liquid for forming a charge transport layer is obtained.

The charge generation layer is impregnated and coated with the obtained coating liquid forming a charge transport layer, and dried at 145° C. for 30 minutes, thereby forming a charge transport layer having a thickness of 30 μm.

A photoreceptor (1) is obtained through the above-described steps.

Preparation of Photoreceptors (2) to (20), and (1C) to (8C)

The photoreceptors (2) to (20), and (1C) to (8C) are prepared by using the same method as that used in the photoreceptor (1) except that as indicated in Table 1 and Table 2, the type of the conductive support is changed in the Preparation of the photoreceptor (1).

Examples 1 to 20, and Comparative Examples 1 to 8

The photoreceptor including the conductive support indicated in Tables 1 and 2 is set as the photoreceptor in Examples 1 to Example 20, and Comparative Examples 1 to Comparative example 8.

Image Evaluation

The photoreceptor in each of the examples is mounted on the image forming apparatus (manufactured by Fuji Xerox Co., Ltd., DOCUPRINT C1100). Further, by using this image forming apparatus, the image printing is performed with 50% density of half-tone under the environment of 20° C. and 40% RH through a method of forming an image by negatively charging the surface of the photoreceptor with monochromatic light of 780 nm. Regarding the obtained image, the occurrence of color points and white points are evaluated. Results are indicated in Tables 1 and 2.

Note that, the evaluation criteria are shown in Table 3. As the details of the evaluation method, the point defect (color point and white point) of the obtained image is classified in three sizes (areas), and the number of point defects of each size is set as a reference (large numerical values) to impart the worst evaluation. Specifically, in a case where 11 point defects in a range of less than 0.05 mm$^2$, 2 point defects in a range of equal to or greater than 0.05 mm$^2$ or less than 0.1 mm$^2$, and 0 point defects in a range of equal to or greater than 0.1 mm$^2$, the evaluation is level "8". Note that, the practically acceptable ranges are from level "1" to level "4" of the evaluation criteria.

TABLE 1

| | | | Blasting treatment condition | | | Properties of conductive support | | | | Evaluation of image quality | |
|---|---|---|---|---|---|---|---|---|---|---|---|
| | Photo-receptor | Conductive support | Irradiation pressure [Mpa] | Time [s] | Step order | Arithmetic mean roughness Ra [μm] | Maximum height Rz [μm] | Mean width RSm [μm] | Surface hardness [HV] | Color point | White point |
| Example 1 | (1) | (1) IP | 0.10 | 30 | After ironing | 0.30 | 1.02 | 220 | 47.9 | 1 | 3 |
| Example 2 | (2) | (2) IP | 0.10 | 60 | After ironing | 0.30 | 5.00 | 212 | 53.0 | 1 | 3 |
| Example 3 | (3) | (3) IP | 0.30 | 30 | After ironing | 1.30 | 1.00 | 230 | 48.1 | 3 | 1 |
| Example 4 | (4) | (4) IP | 0.30 | 60 | After ironing | 1.29 | 4.98 | 210 | 55.4 | 3 | 1 |
| Example 5 | (5) | (5) IP | 0.15 | 30 | After ironing | 0.79 | 2.47 | 189 | 52.2 | 1 | 1 |
| Example 6 | (6) | (6) IP | 0.15 | 10 | After ironing | 0.98 | 2.45 | 80 | 48.3 | 1 | 1 |
| Example 7 | (7) | (7) IP | 0.15 | 120 | After ironing | 0.50 | 2.06 | 400 | 55.0 | 1 | 1 |
| Example 8 | (8) | (8) IP | 0.15 | 30 | After ironing | 1.24 | 4.04 | 222 | 58.9 | 1 | 1 |
| Example 9 | (9) | (9) IP | 0.15 | 30 | After ironing | 0.61 | 3.56 | 184 | 51.5 | 1 | 1 |
| Example 10 | (10) | (10) IP | 0.15 | 30 | After ironing | 0.55 | 2.88 | 179 | 53.4 | 1 | 1 |
| Example 11 | (11) | (11) IP | 0.15 | 30 | Before ironing | 0.31 | 1.01 | 240 | 45.5 | 1 | 1 |
| Example 12 | (12) | (12) IP | 0.35 | 30 | Before ironing | 1.30 | 1.11 | 255 | 52.5 | 1 | 1 |
| Example 13 | (13) | (13) IP | 0.35 | 30 | Before ironing | 1.29 | 4.95 | 264 | 57.3 | 3 | 1 |
| Example 14 | (14) | (14) IP | 0.20 | 30 | Before ironing | 0.45 | 2.00 | 244 | 55.0 | 1 | 1 |
| Example 15 | (15) | (15) IP | 0.20 | 10 | Before ironing | 0.96 | 2.55 | 80 | 56.1 | 1 | 1 |
| Example 16 | (16) | (16) IP | 0.20 | 120 | Before ironing | 0.65 | 3.30 | 400 | 54.8 | 1 | 1 |
| Example 17 | (17) | (17) IP | 0.20 | 30 | Before ironing | 1.13 | 4.08 | 212 | 55.4 | 1 | 1 |
| Example 18 | (18) | (18) IP | 0.20 | 30 | Before ironing | 0.83 | 3.56 | 223 | 55.9 | 1 | 1 |
| Example 19 | (19) | (19) IP | 0.20 | 30 | Before ironing | 0.74 | 1.95 | 252 | 48.4 | 1 | 1 |
| Example 20 | (20) | (20) Cutting | — | — | — | 0.10 | 1.05 | 246 | 44.1 | 1 | 1 |

TABLE 2

| | | | | Blasting treatment condition | | | Properties of conductive support | | | | Evaluation of image quality | |
|---|---|---|---|---|---|---|---|---|---|---|---|---|
| | Photo-receptor | Conductive support | | Irradiation pressure [Mpa] | Time [s] | Step order | Arithmetic mean roughness Ra [μm] | Maximum height Rz [μm] | Mean width RSm [μm] | Surface hardness [HV] | Color point | White point |
| Comparative example 1 | (1C) | (1C) | IP | 0.05 | 30 | Before ironing | 0.32 | 5.98 | 233 | 59.0 | 1 | 5 |
| Comparative example 2 | (2C) | (2C) | IP | 0.50 | 60 | Before ironing | 1.33 | 6.31 | 206 | 56.0 | 5 | 1 |
| Comparative example 3 | (3C) | (3C) | IP | 0.50 | 30 | Before ironing | 1.41 | 4.13 | 196 | 55.0 | 6 | 1 |
| Comparative example 4 | (4C) | (4C) | IP | — | — | — | 0.15 | 7.04 | 488 | 57.0 | 1 | 5 |
| Comparative example 5 | (5C) | (5C) | IP | 0.15 | 30 | Before ironing | 0.29 | 5.01 | 202 | 47.2 | 1 | 5 |
| Comparative example 6 | (6C) | (6C) | IP | — | — | Before ironing | 0.34 | 3.85 | 460 | 55.2 | 1 | 5 |
| Comparative example 7 | (7C) | (7C) | IP | 0.20 | 5 | Before ironing | 0.92 | 2.35 | 77 | 50.1 | 5 | 1 |
| Comparative example 8 | (8C) | (8C) | IP | 0.20 | 140 | Before ironing | 0.62 | 3.00 | 405 | 56.8 | 1 | 5 |

TABLE 3

| | Number of point defects | | |
|---|---|---|---|
| Evaluation criteria | Less than 0.05 $mm^2$ | Equal to or greater than 0.05 $mm^2$ and less than 0.1 $mm^2$ | Equal to or greater than 0.1 $mm^2$ |
| 1 | 0 | 0 | 0 |
| 2 | 1 | 1 | 0 |
| 3 | 2 | 1 | 0 |
| 4 | 3 | 1 | 0 |
| 5 | 4 to 5 | 1 | 0 |
| 6 | 6 to 7 | 1 | 1 |
| 7 | 8 to 9 | 2 | 2 |
| 8 | 10 to 11 | 3 | 3 |
| 9 | 12 to 13 | 4 | 4 |
| 10 | Equal to more than 14 | Equal to more than 5 | Equal to more than 5 |

From the above results, it is found that the images in which the occurrence of color point and white point is prevented are obtained in the present examples as compared with comparative examples.

In addition, the surface hardness is enhanced in Examples 1 to 19 using an impact press tube as compared with Example 20 using the cylindrical member (conductive support) obtained by cutting the surface. Accordingly, it is found that the image in which the occurrence of color point and white point is prevented is obtained by preparing the conductive support through the impacting, and the conductive support which is excellent in the technical strength is obtained.

Details of abbreviations in Tables 1 and 2 are as follows.

"IP" represents an impact press tube.

"Cutting" represents a conductive support obtained by cutting the surface of aluminum tube material (cylindrical tube).

Details of the charge transport material and the antioxidant which are used to form a charge transport layer.

Butadiene charge transport material: compound represented by the following structural formula (CT1A)

Benzidine charge transport material: compound represented by the following structural formula (CT2A)

Hindered phenol antioxidant: compound represented by the following structural formula (HP-1)

(CT1A)

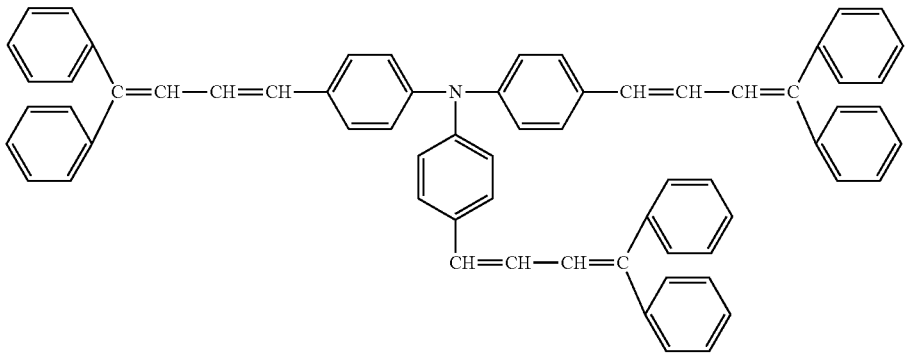

-continued (CT2A)

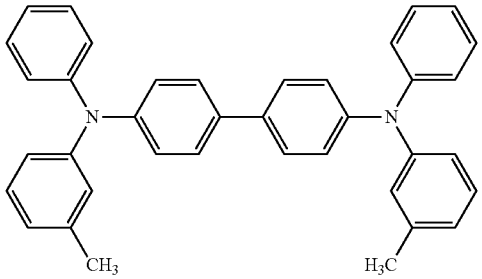

(HP-1)

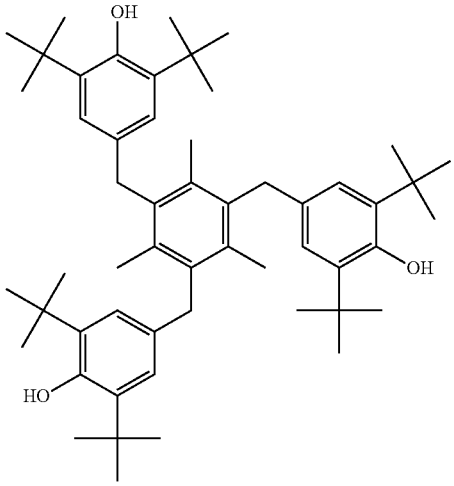

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive support for an electrophotographic photoreceptor, comprising:

a cylindrical member containing aluminum, wherein the cylindrical member has an arithmetic mean roughness Ra of 1.3 μm or less, a maximum height of roughness profile Rz of 5.0 μm or less, and a mean width of roughness profile elements RSm in an axial direction of from 160 μm to 400 μm.

2. The conductive support for an electrophotographic photoreceptor according to claim 1, wherein the cylindrical member has an arithmetic mean roughness Ra of 1.0 μm or less.

3. The conductive support for an electrophotographic photoreceptor according to claim 1, wherein the cylindrical member has an arithmetic mean roughness Ra of 0.6 μm or less.

4. The conductive support for an electrophotographic photoreceptor according to claim 1, wherein the cylindrical member has an arithmetic mean roughness Ra of 0.3 μm or more.

5. The conductive support for an electrophotographic photoreceptor according to claim 1, wherein the cylindrical member has a mean width of roughness profile elements RSm in the axial direction of from 160 μm to 350 μm.

6. The conductive support for an electrophotographic photoreceptor according to claim 1, wherein the cylindrical member has a mean width of roughness profile elements RSm in the axial direction of from 160 μm to 300 μm.

7. The conductive support for an electrophotographic photoreceptor according to claim 1, wherein the cylindrical member has a mean width of roughness profile elements RSm in the axial direction of from 200 μm to 250 μm.

8. The conductive support for an electrophotographic photoreceptor according to claim 1, wherein the cylindrical member has a surface hardness of from 45 HV to 60 HV.

9. The conductive support for an electrophotographic photoreceptor according to claim 1, wherein the cylindrical member has a surface hardness of from 48 HV to 58 HV.

10. The conductive support for an electrophotographic photoreceptor according to claim 1, wherein the cylindrical member has a surface hardness of from 50 HV to 55 HV.

11. The conductive support for an electrophotographic photoreceptor according to claim 1, wherein the cylindrical member is an impact press tube.

12. The conductive support for an electrophotographic photoreceptor according to claim 11, wherein a thickness of the conductive support is from 0.3 mm to 0.7 mm.

13. The conductive support for an electrophotographic photoreceptor according to claim 11, wherein a thickness of the conductive support is from 0.35 mm to 0.5 mm.

14. An electrophotographic photoreceptor comprising:

the conductive support for an electrophotographic photoreceptor according to claim 1; and a photosensitive layer provided on the conductive support for an electrophotographic photoreceptor.

15. A process cartridge comprising the electrophotographic photoreceptor according to claim 14, wherein the process cartridge is detachable from an image forming apparatus.

* * * * *